US009280086B2

(12) United States Patent
Hasegawa

(10) Patent No.: US 9,280,086 B2
(45) Date of Patent: Mar. 8, 2016

(54) IMAGE FORMING APPARATUS HAVING DEVELOPER SUPPLYING OPERATION

(75) Inventor: Hideaki Hasegawa, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 305 days.

(21) Appl. No.: 13/338,596

(22) Filed: Dec. 28, 2011

(65) Prior Publication Data

US 2012/0183311 A1 Jul. 19, 2012

(30) Foreign Application Priority Data

Jan. 12, 2011 (JP) ..... 2011-004403

(51) Int. Cl.
*G03G 15/08* (2006.01)

(52) U.S. Cl.
CPC ..... *G03G 15/0851* (2013.01); *G03G 15/086* (2013.01); *G03G 15/0856* (2013.01)

(58) Field of Classification Search
CPC ..... G03G 15/0851; G03G 15/0856; G03G 15/086
USPC ..... 399/27
See application file for complete search history.

(56) References Cited

U.S. PATENT DOCUMENTS

2006/0078343 A1* 4/2006 Shin et al. ..... 399/57
2006/0127109 A1* 6/2006 Itoyama et al. ..... 399/27
2006/0291880 A1* 12/2006 Kitora ..... 399/27
2007/0058996 A1* 3/2007 Sakita et al. ..... 399/27
2007/0065167 A1* 3/2007 Yamamura ..... 399/55
2007/0280738 A1* 12/2007 Uetake et al. ..... 399/253
2007/0280745 A1* 12/2007 Takashima et al. ..... 399/281
2008/0019712 A1* 1/2008 Tanaka et al. ..... 399/30
2008/0075482 A1* 3/2008 Hirota ..... 399/30
2008/0317486 A1* 12/2008 Monma et al. ..... 399/45
2009/0003107 A1 1/2009 Riho et al.
2009/0003850 A1* 1/2009 Yamamoto et al. ..... 399/27
2009/0003884 A1 1/2009 Kawamura et al.
2009/0010659 A1* 1/2009 Watanabe ..... 399/27
2009/0047042 A1 2/2009 Nishi et al.
2009/0226197 A1* 9/2009 Handa et al. ..... 399/55

(Continued)

FOREIGN PATENT DOCUMENTS

CN 101334614 A 12/2008
CN 101334615 A 12/2008

(Continued)

OTHER PUBLICATIONS

Machine translation of JP 2010072178 A.*

(Continued)

*Primary Examiner* — David Bolduc
(74) *Attorney, Agent, or Firm* — Fitzpatrick, Cella, Harper & Scinto

(57) ABSTRACT

An image forming apparatus includes an image bearing member, a developing container, a developer supplying member, and a measuring portion for measuring a print pixel number of an image to be formed. In addition, a supplying device supplies the developer to the developer supplying member on the basis of a measured print pixel number after image formation, and a detecting device detects an amount of the developer contained in the developing container by detecting electrostatic capacity between the first electrode member and the second electrode member after the supplying operation by the supplying device.

6 Claims, 12 Drawing Sheets

(56) References Cited

U.S. PATENT DOCUMENTS

| | | | | |
|---|---|---|---|---|
| 2010/0086322 | A1* | 4/2010 | Koizumi et al. | 399/53 |
| 2011/0058824 | A1* | 3/2011 | Morimoto et al. | 399/27 |
| 2011/0064435 | A1* | 3/2011 | Takahashi et al. | 399/58 |
| 2011/0085808 | A1* | 4/2011 | Hirata | 399/27 |
| 2011/0085811 | A1* | 4/2011 | Handa et al. | 399/55 |
| 2011/0200340 | A1* | 8/2011 | Kojima et al. | 399/12 |
| 2011/0206390 | A1 | 8/2011 | Yamamoto et al. | |
| 2011/0222873 | A1* | 9/2011 | Watanabe | 399/27 |
| 2011/0229175 | A1 | 9/2011 | Yamamoto et al. | |
| 2011/0305468 | A1* | 12/2011 | Fujiwara | 399/27 |
| 2012/0070169 | A1 | 3/2012 | Yamamoto et al. | |
| 2012/0148270 | A1* | 6/2012 | Yamada | 399/27 |
| 2012/0230714 | A1 | 9/2012 | Yamamoto et al. | |

FOREIGN PATENT DOCUMENTS

| | | | | |
|---|---|---|---|---|
| CN | 101349882 | A | | 1/2009 |
| CN | 101369118 | A | | 2/2009 |
| JP | 2006091211 | A | * | 4/2006 |
| JP | 2009-9036 | A | | 1/2009 |
| JP | 2009198697 | A | * | 9/2009 |
| JP | 2010072178 | A | * | 4/2010 |

OTHER PUBLICATIONS

Notification of the First Office Action dated Apr. 1, 2013, in Chinese Application No. 201210007864.7.

* cited by examiner

IMAGE FORMING APPARATUS HAVING DEVELOPER SUPPLYING OPERATION

FIELD OF THE INVENTION AND RELATED ART

The present invention relates to an image forming apparatus of an electrophotographic type in general and particularly relates to the image forming apparatus including a developer amount detecting means for detecting an amount of a developer in a developing container for containing the developer.

In a conventional image forming apparatus of the electrophotographic type, a process cartridge type in which a process cartridge is detachably mountable to a main assembly of the image forming apparatus is widely employed. In the process cartridge type, e.g., a photosensitive drum and, as process means acting on the photosensitive drum, a charging roller, a cleaning device and a developing device are integrally assembled into a cartridge to provide the process cartridge. According to the process cartridge type, it is possible to perform maintenance of the image forming apparatus, such as replenishing of the developer or part exchange of the photosensitive drum or the like which reaches its end of a lifetime, by a user himself (herself) without relying on a service person.

In the image forming apparatus of the process cartridge type, in the case where the developer is used up, the user himself (herself) exchanges the process cartridge, so that the image forming apparatus is capable of forming an image again. Therefore, in the image forming apparatus of the process cartridge type, the developer amount detecting means for permitting detection of a level of a remaining developer amount in the developing container for containing the developer is provided in some cases. This is because by notifying the user that consumption of the developer is detected by using the developer amount detecting means, the user can know how much developer, which can be subjected to image formation, remains in the process cartridge in real time.

As a method of the developer amount detecting means in a developing device of a non-magnetic one-component developing type using a non-magnetic one-component developer, there is the following method in which electrostatic capacity between a supplying roller as a developer supplying member and a developing roller as a developer carrying member is detected (Japanese Laid-Open Patent Application (JP-A) 2009-9036). That is, in the developing container, the supplying roller including an electroconductive metal support and a foam layer provided around the metal support, and the developing roller including an electroconductive support and an elastic layer provided around the metal support are provided rotatably in contact with each other. The foam layer of the supplying roller is formed by a urethane sponge layer in which the developer can enter. Further, the developing device can retain a first attitude in which the developing roller contacts the photosensitive drum and a second attitude in which the developing roller is separated (spaced) from the photosensitive drum. Then, in the second attitude in which a developing operation is not performed, a voltage for detection is applied to the metal support of the supplying roller, so that the electrostatic capacity between the developing roller and the supplying roller is detected. This electrostatic capacity changes depending on an amount of an insulating developer present between the developing roller and the supplying roller and therefore it is possible to detect the developer amount by establishing association of a relationship between the electrostatic capacity and the developer amount in advance.

However, the developer amount detecting method as described above is accompanied with the following problem in terms of detection accuracy.

That is, in the case where an image with a high print ratio is formed, the amount of the developer contained in the supplying roller is temporarily decreased immediately after the image formation. For that reason, in that state, when the developer amount is detected, there is a possibility that the developer amount is erroneously detected so that it is less than an actual developer amount. Against this, an auxiliary driving operation performed for restoring a developer content in the supplying roller in a period from an end of the image formation to start of the developer amount detecting operation is effective. However, when this driving operation is excessively performed, there is a possibility of not only acceleration of abrasion (wearing) deterioration of respective members but also a lowering in productivity of the image formation.

Incidentally, in the above, the conventional problem was described by taking, as an example, the image forming apparatus of the process cartridge type for which the detection of the remaining developer amount level by the developer amount detecting means was particularly useful. However, in the case where the developer amount detecting method as described above is employed, there arises a similar problem also in image forming apparatuses in which the process cartridge type is not employed.

SUMMARY OF THE INVENTION

A principal object of the present invention is to provide an image forming apparatus capable of preventing a lowering in detection accuracy of a developer amount, which can occur depending on a difference in image formed before the detection, without shortening a lifetime of a developing device and without lowering productivity of image formation.

According to an aspect of the present invention, there is provided an image forming apparatus comprising: an image bearing member for bearing an electrostatic latent image; a developing container for containing a developer; a developer carrying member, including a first electrode member, for carrying the developer contained in the developing container to develop the electrostatic latent image; a developer supplying member, including a second electrode member and a foam layer provided around the second electrode member, for supplying the developer contained in the developing container to the developer carrying member by rotation in contact with the developer carrying member; a measuring portion for measuring a print pixel number of an image to be formed; a supplying device for performing a supplying operation for supplying the developer to the developer supplying member on the basis of a measured print pixel number after image formation; and a detecting device for detecting an amount of the developer contained in the developing container by detecting electrostatic capacity between the first electrode member and the second electrode member after the supplying operation by the supplying device.

According to the present invention, it is possible to prevent the lowering in detection accuracy of the developer amount, which can occur depending on the difference in image formed before the detection, without shortening the lifetime of the developing device and without lowering the productivity of image formation.

These and other objects, features and advantages of the present invention will become more apparent upon a consideration of the following description of the preferred embodiments of the present invention taken in conjunction with the accompanying drawings.

Figure 1:
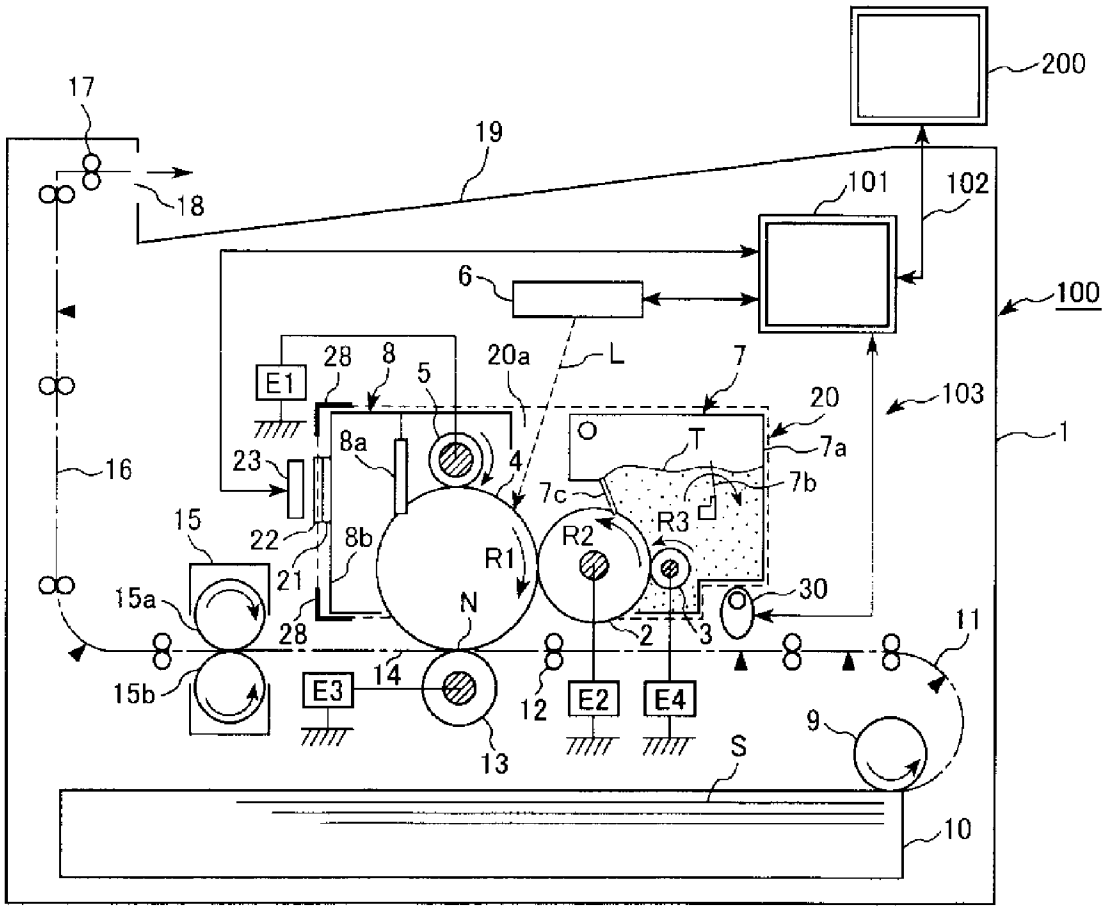
FIG. 1 is a schematic sectional view of an image forming apparatus according to an embodiment of the present invention.
Figure 2:
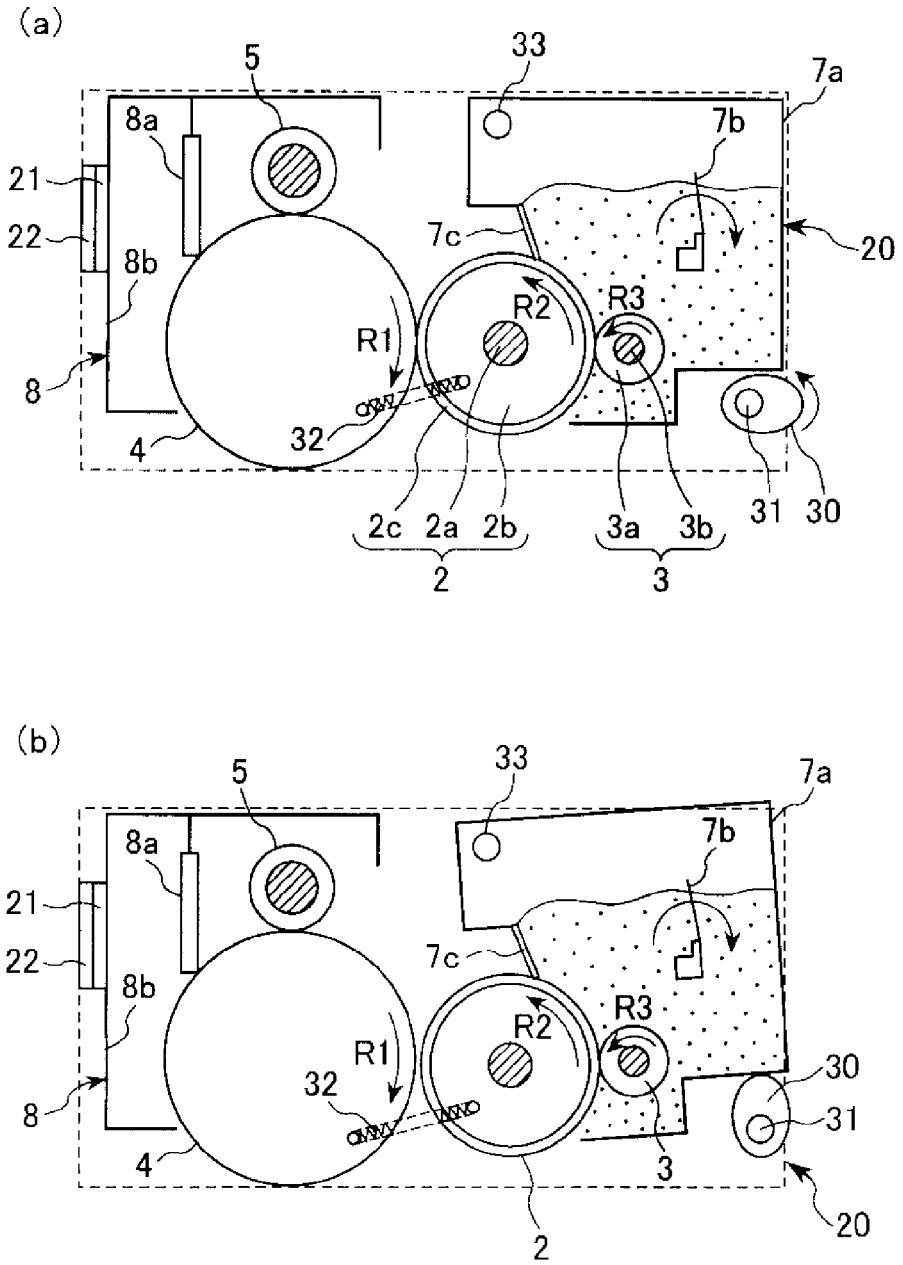

Parts (a) and (b) of FIG. 2 are schematic sectional views of a process cartridge in the image forming apparatus shown in FIG. 1.

Figure 3:
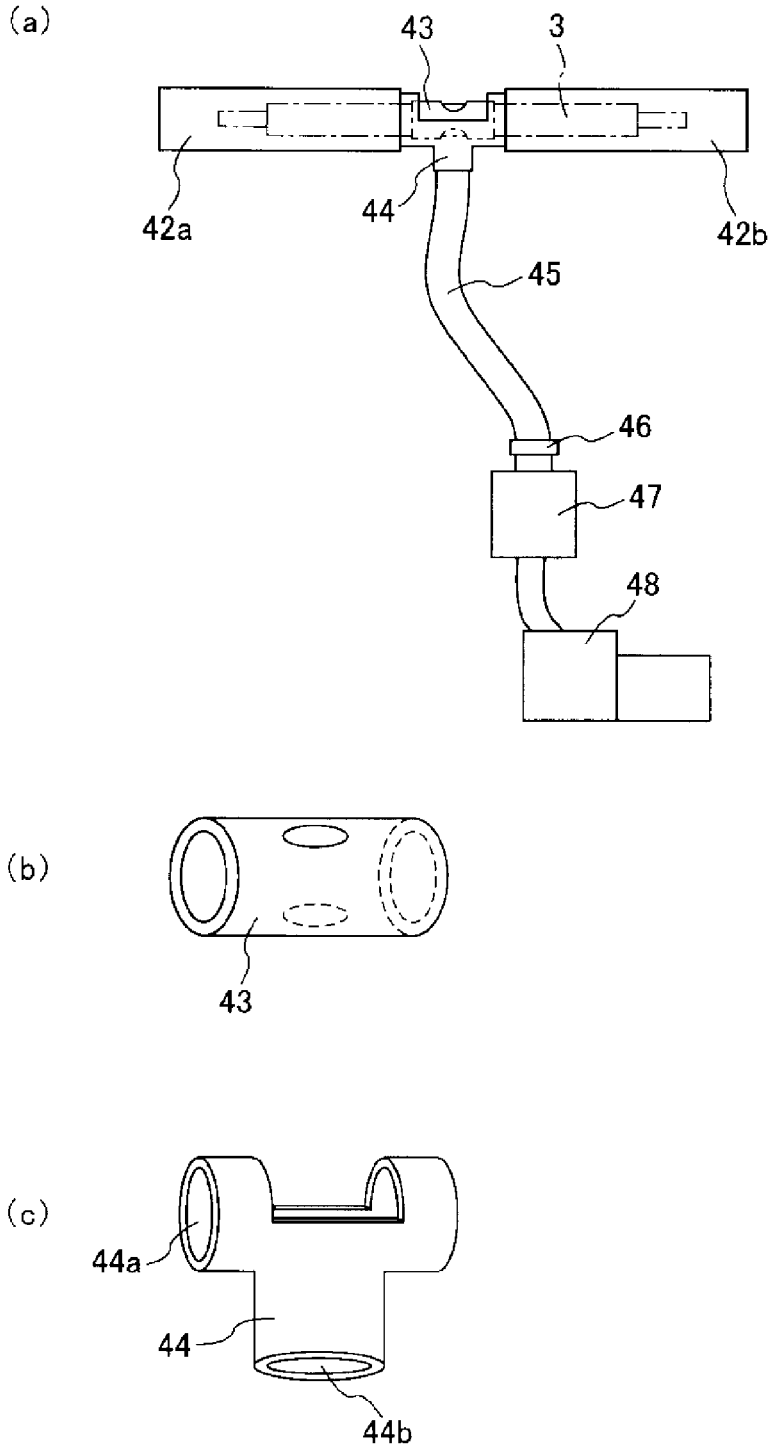

Part (a) of FIG. 3 is a schematic view showing a measuring method of a surface air flow amount of a developer supplying member, (b) is a schematic view showing a jig used for measurement, and (c) is a schematic view showing a ventilation holder used for measurement.

Figure 4:
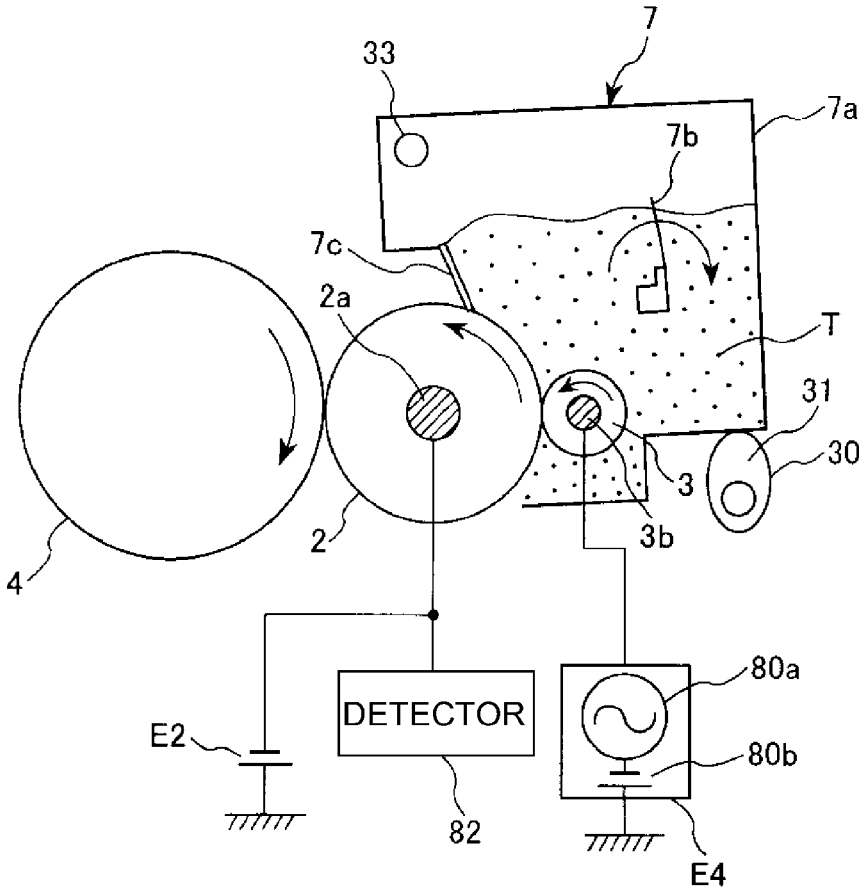

FIG. 4 is a schematic sectional view of a developing device for illustrating a developer amount detecting means in the image forming apparatus shown in FIG. 1.

Figure 5:
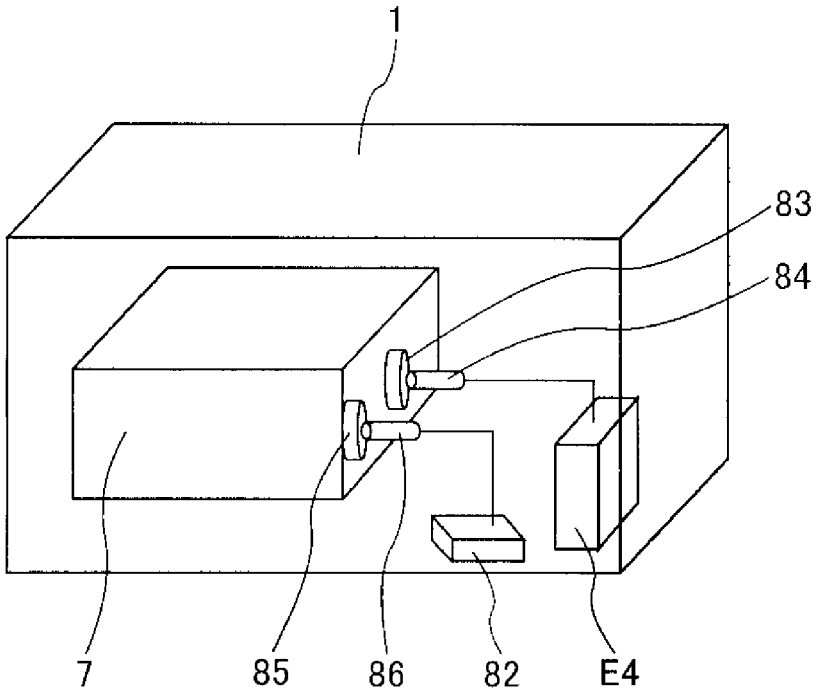

FIG. 5 is a block diagram for illustrating the developer amount detecting means in the image forming apparatus shown in FIG. 1.

Figure 6:
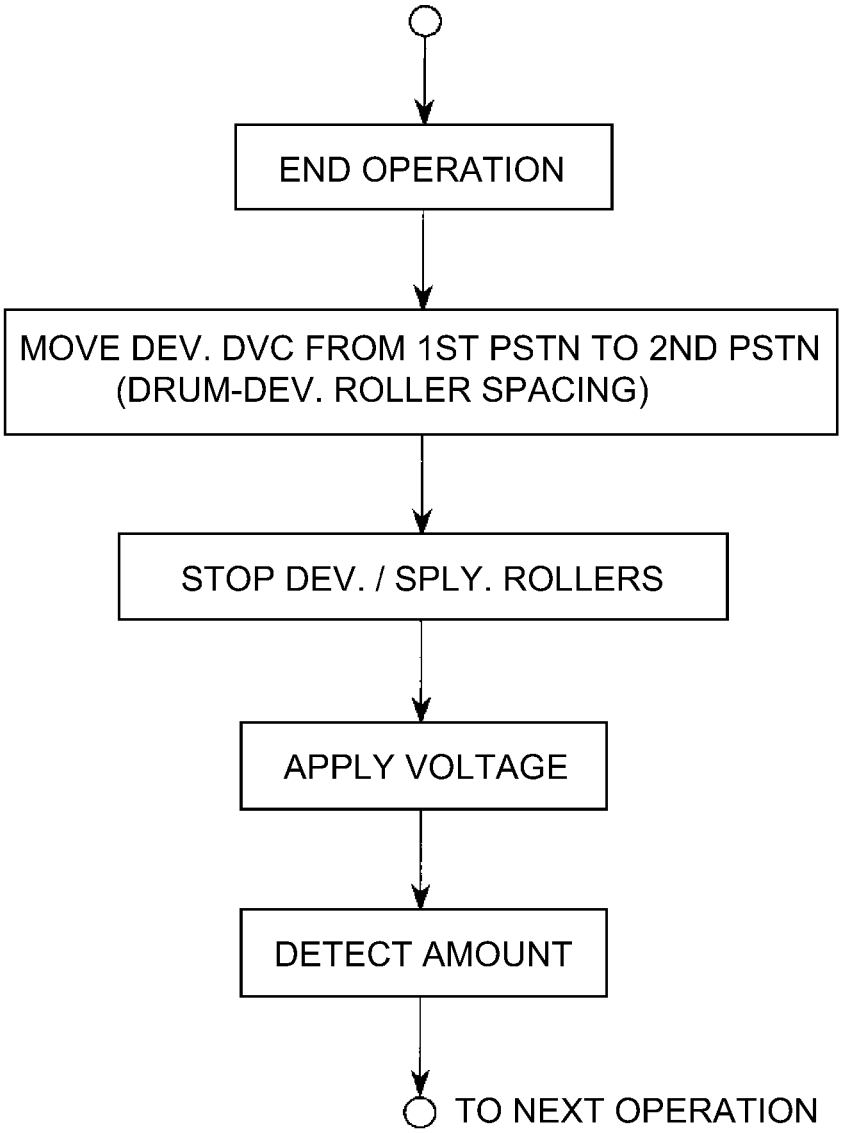

FIG. 6 is a flow chart showing a basic operation flow of a developer amount detecting method to which the present invention is applicable.

Figure 7:
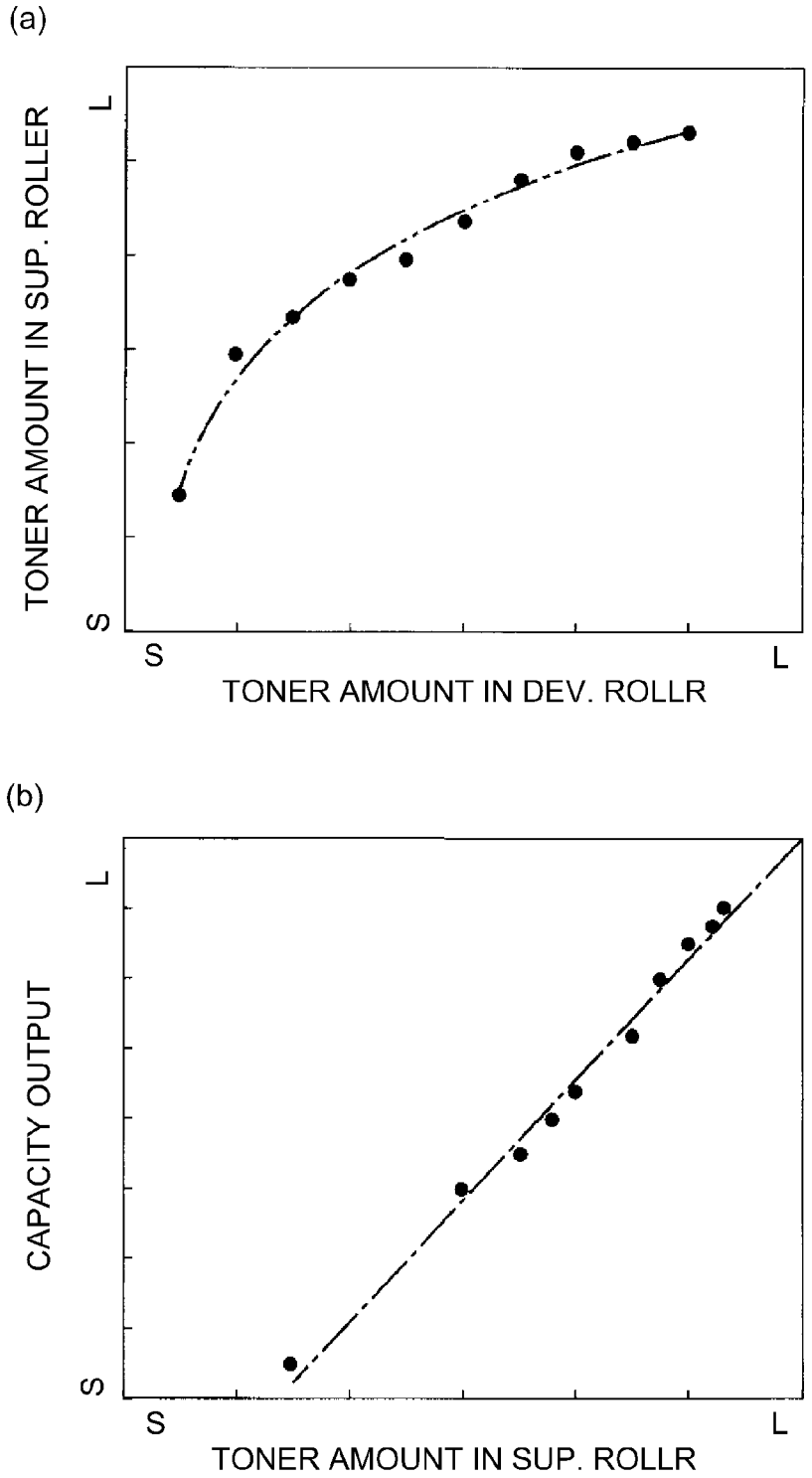

Part (a) of FIG. 7 is a graph showing a relationship between a toner amount in a developing container and an amount of a toner contained in a supplying roller, and (b) of FIG. 7 is a graph showing a relationship between the amount of the toner contained in the supplying roller and an output of an electrostatic capacity detector.

Figure 8:
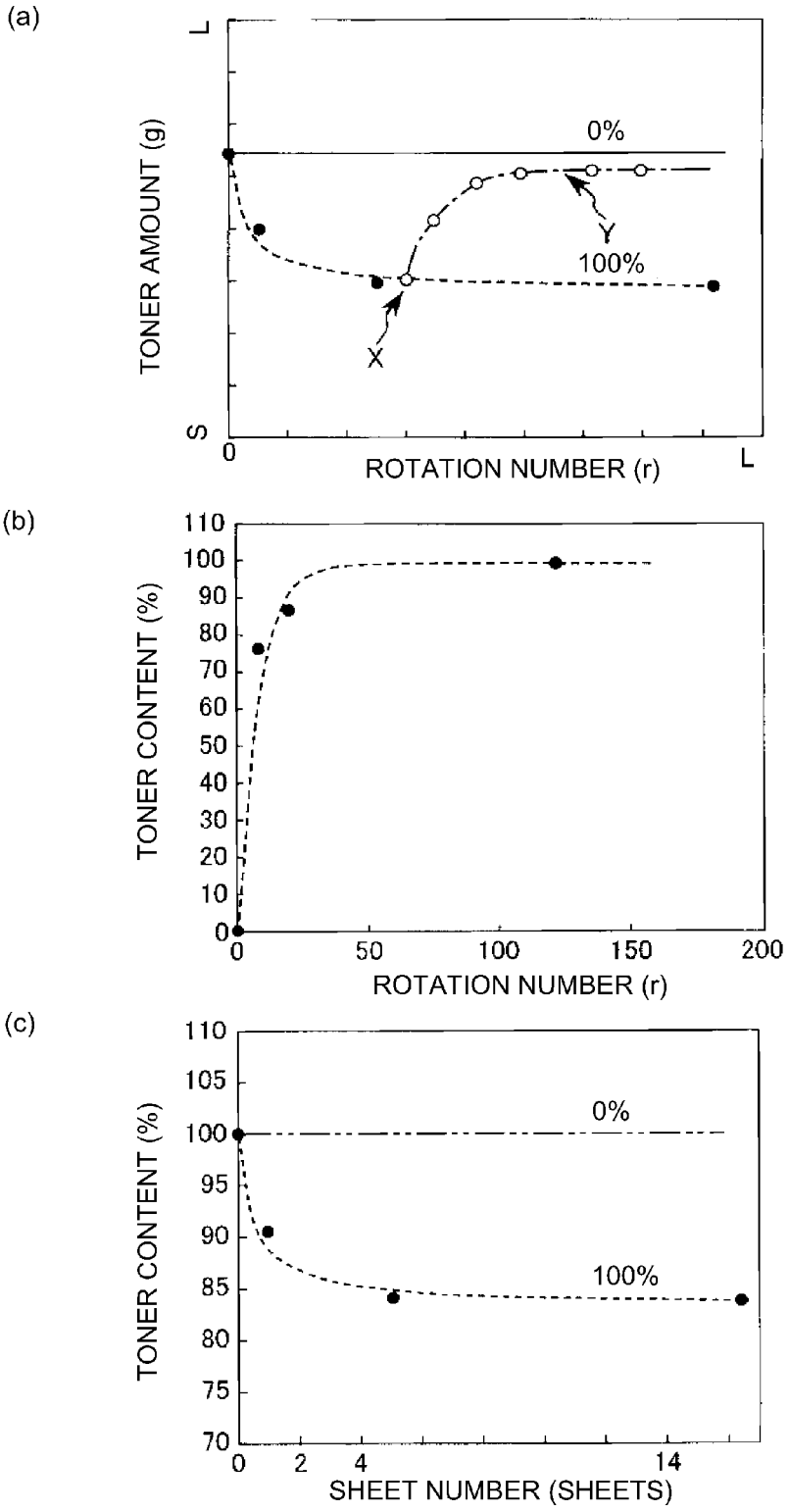
Figure 9:
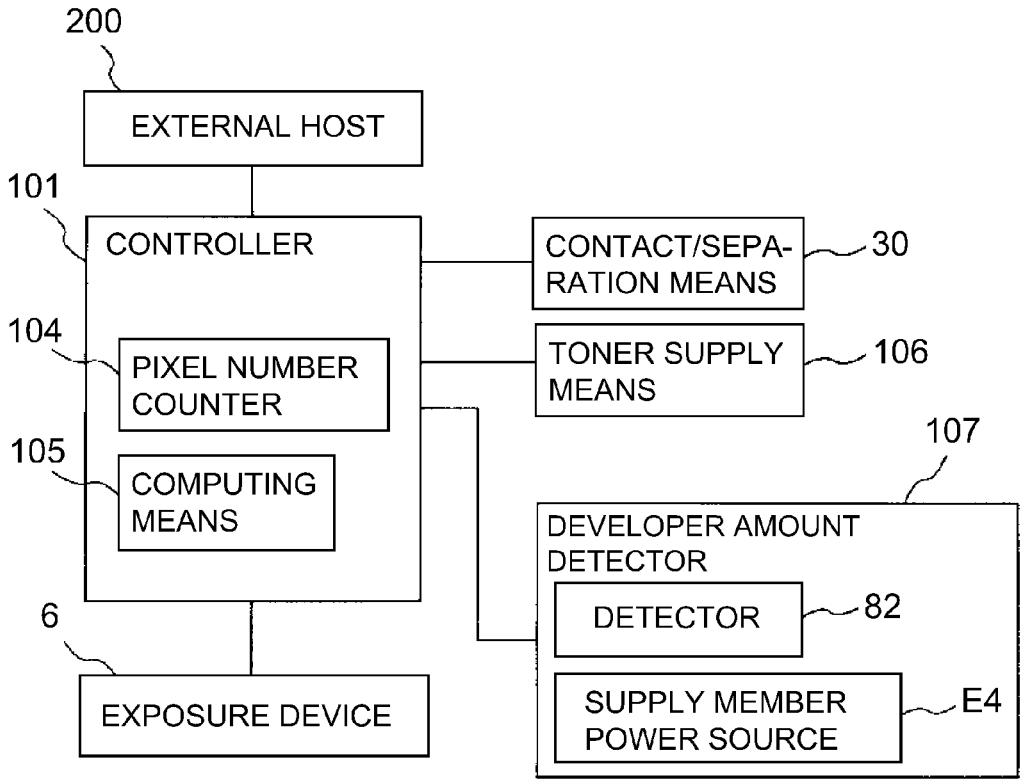

Part (a) of FIG. 8 is a graph showing a state in which the amount of the toner contained in the supplying roller is decreased by formation of an image with a high print ratio, (b) of FIG. 8 is a graph showing a state in which a toner content in the supplying roller is restored by rotational drive of the supplying roller, and (c) of FIG. 8 is a graph showing a relationship between the number of sheets subjected to image formation with a high print ratio and the toner content in the supplying roller, FIG. 9 is a schematic control block diagram of a toner supplying operation in accordance with the present invention.

Figure 10:
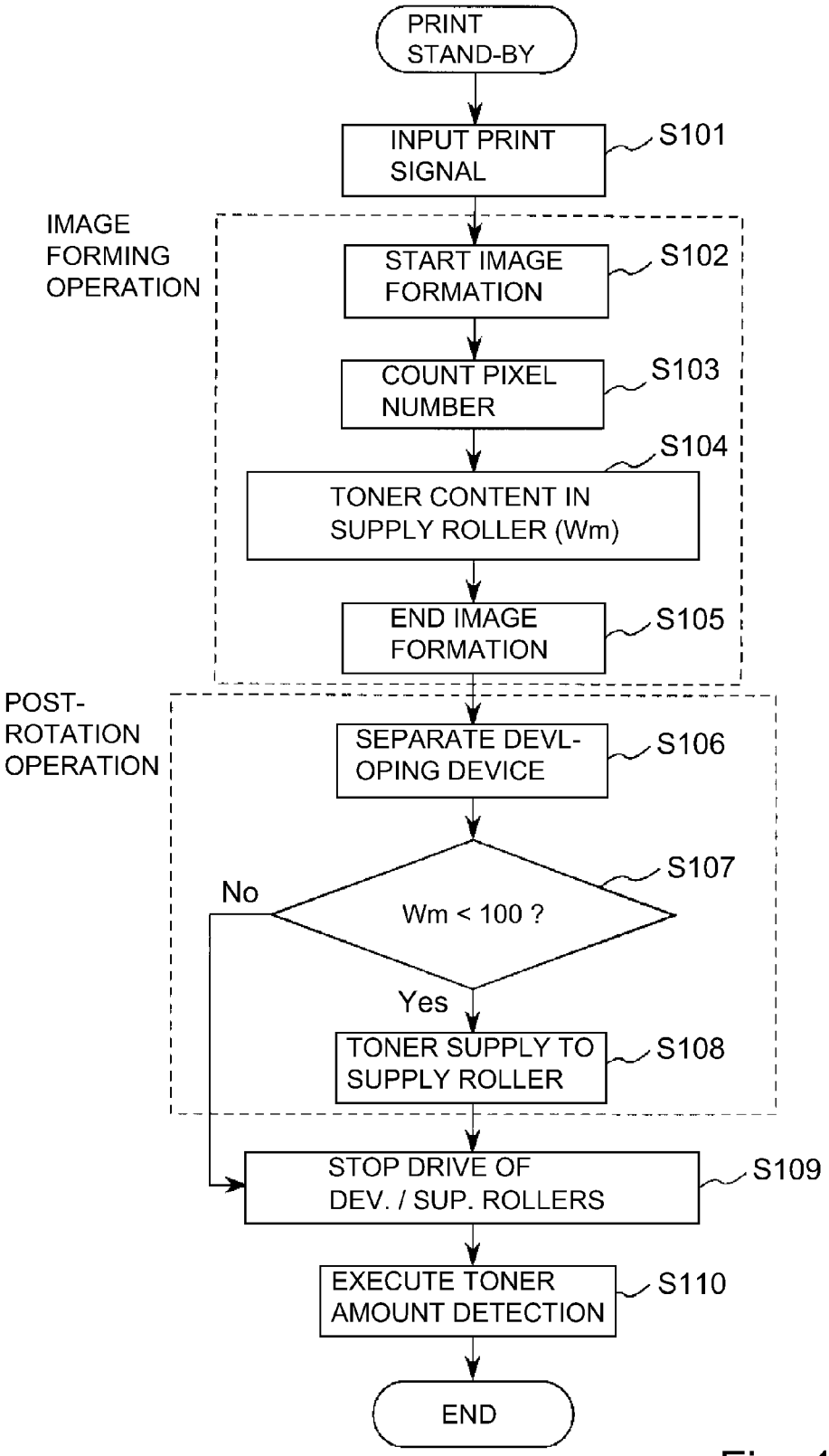

FIG. 10 is a flow chart of an example of a series of operations of the image forming apparatus including the toner supplying operation in accordance with the present invention.

Figure 11:
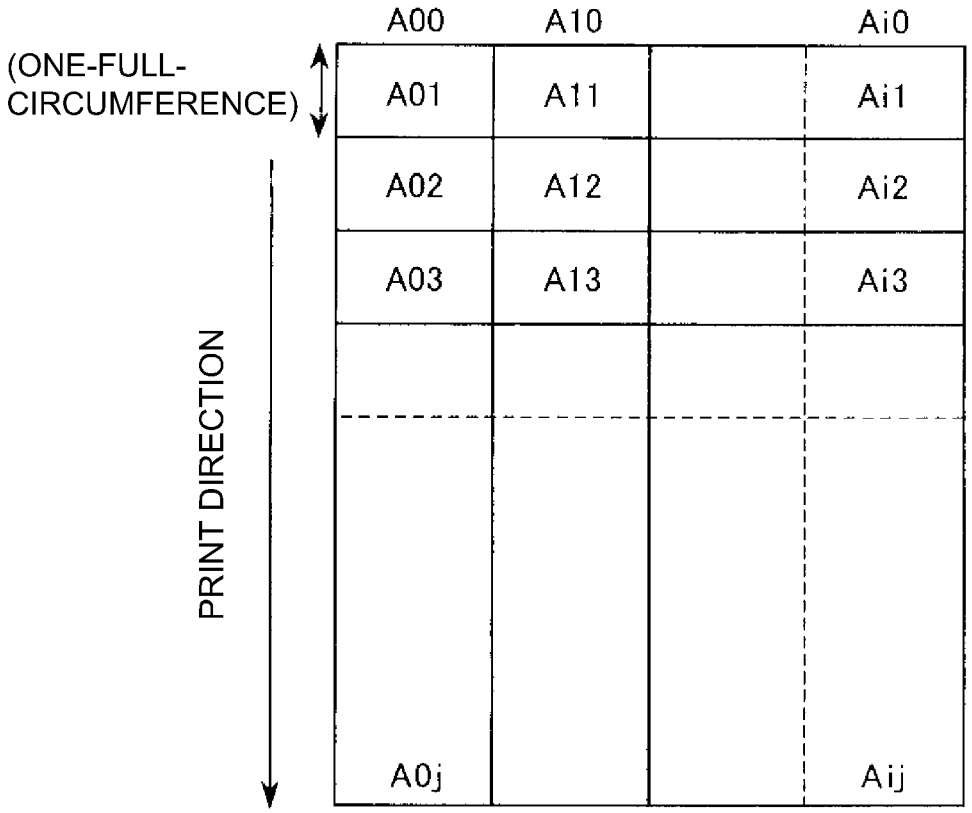

FIG. 11 is a schematic view for illustrating a pixel number measuring method in another embodiment of the present invention.

Figure 12:
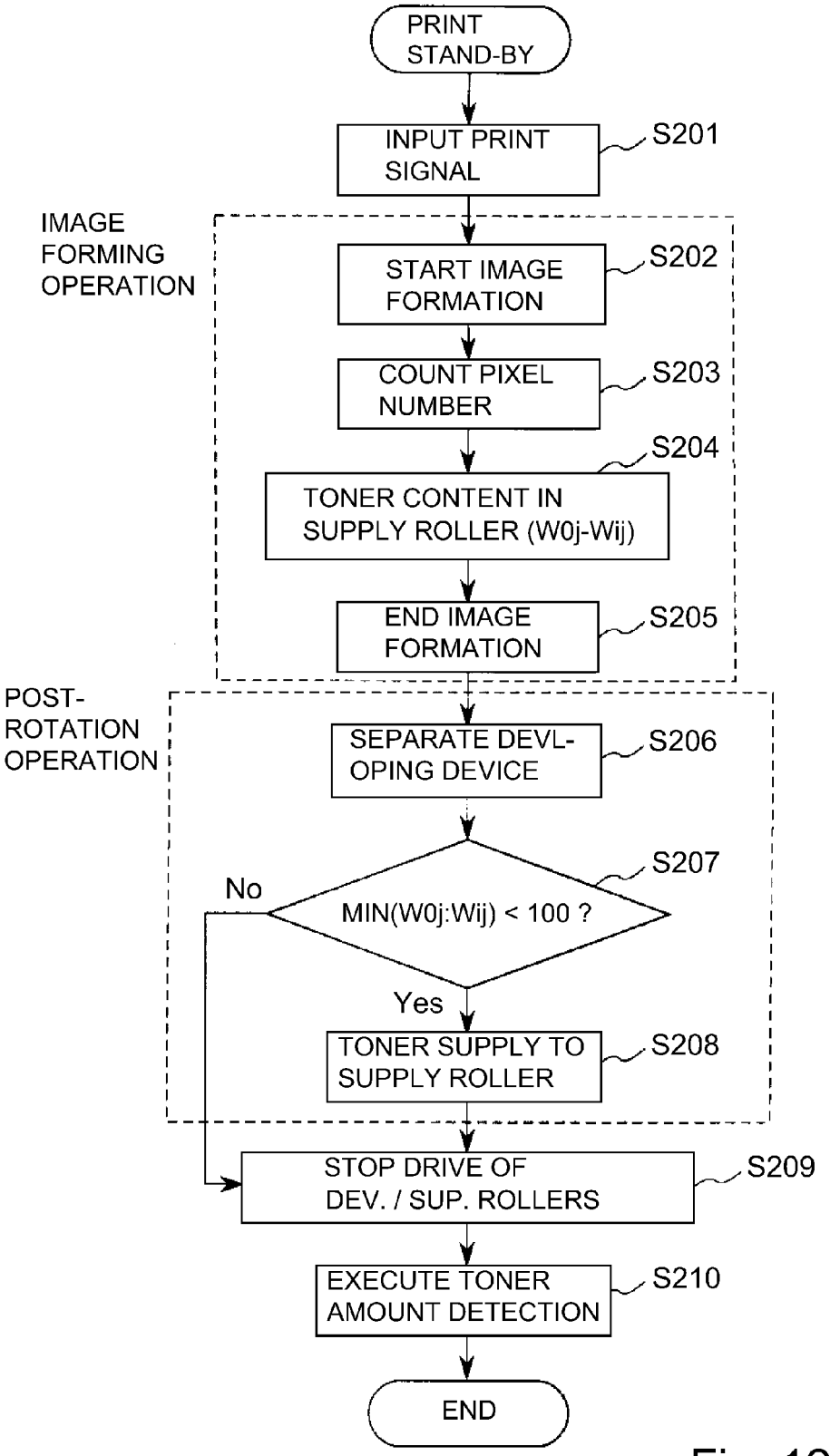

FIG. 12 is a flow chart of another example of a series of operations of the image forming apparatus including the toner supplying operation in accordance with the present invention.

DESCRIPTION OF THE PREFERRED EMBODIMENTS

Hereinbelow, the image forming apparatus according to the present invention will be described more specifically with reference to the drawings.

Embodiment 1

1. General Structure and Operation of Image Forming Apparatus

FIG. 1 shows a general structure of an image forming apparatus 100 according to an embodiment of the present invention. The image forming apparatus 100 in this embodiment is a laser beam printer using an electrophotographic type. To a control circuit portion 101 as a control means of the image forming apparatus 100, an external host device (host computer) 200 is connected via an interface 102. The image forming apparatus 100 forms, on a recording material (recording medium) S, an image corresponding to image data (electrical image information) inputted from the external host device 200, thus outputting an image-formed product. The control circuit portion 101 is the control means for controlling an operation of the image forming apparatus 100 and transfers various electrical information signals with the external host device 200. Further, the control circuit portion 101 manages processing of electrical information signals inputted from various process devices or sensors of an image forming portion 103 described below, processing of instruction signals to the various process devices, predetermined initial sequence control and predetermined image formation sequence. The control circuit portion 101 executes the control in accordance with control programs or reference tables stored in a non-volatile memory (NVRAM). Examples of the external host device 200 include a host computer, a network device, an image reader, and a facsimile machine. Incidentally, the image forming apparatus 100 can form the image on recording paper, an OHP sheet, a post card, an envelope, a label or the like as the recording material S.

In a main assembly 1 of the image forming apparatus 100 (hereinafter referred to as an apparatus main assembly), the image forming portion 103 is provided. The image forming portion 103 includes a photosensitive drum 4 which is a drum type electrophotographic photosensitive member as an image bearing member. The photosensitive drum 4 is provided rotatably to a process cartridge described later and is rotationally driven in an arrow R1 direction (clockwise direction) indicated in FIG. 1 at a predetermined peripheral speed (process speed) by a driving motor (not shown) as a driving means provided to the apparatus main assembly 1. The photosensitive drum 4 is constituted by applying an organic photoconductor layer on an outer surface of an aluminum cylinder. The aluminum cylinder of the photosensitive drum 4 is electrically grounded by an electroconductive member via the apparatus main assembly 1.

A peripheral surface of the rotating photosensitive drum 4 is uniformly charged to a predetermined polarity (negative in this embodiment) and potential by a charging roller 5 which is a contact type charging member as a charging means. The charging roller 5 includes a core metal and an electroconductive elastic (member) layer formed around and coaxially with the core metal. The charging roller 5 is disposed so that its rotational axis direction is substantially parallel to a rotational axis direction of the photosensitive drum 4. Further, the charging roller 5 contacts the photosensitive drum 4 with a predetermined pressure against elasticity of the electroconductive elastic layer. The core metal of the charging roller 5 is rotatably supported by the process cartridge 20 described later via bearing at its end portions with respect to the rotational axis direction of the charging roller 5. The charging roller 5 is rotated by the rotation of the photosensitive drum 4. To the charging roller 5, a charging power source E1 as a charging voltage application means is connected. Further, in this embodiment, during the image formation, to the core metal of the charging roller 5, a DC voltage of about −1000 V is applied as a charging voltage (charging bias). As a result, the surface of the photosensitive drum 4 is uniformly charged to a dark-portion potential VD of about −500 V.

The uniformly charged surface of the photosensitive drum 4 is exposed to light by an exposure device (laser scanner unit)

6 as an exposure means. As a result, an electrostatic latent image (electrostatic image) corresponding to image information is formed on the surface of the photosensitive drum 4. In this embodiment, the exposure device 6 employs an image exposure type in which an image portion is exposed to light. To the exposure device 6, a time-serial electric digital pixel signal of the image information which is image-processed after being inputted from the external host device 200 into the control circuit portion 101 via the interface 102. The exposure device 6 includes a laser outputting portion for outputting laser light L (exposure beam) modulated correspondingly to the inputted time-serial electric digital pixel signal, a rotatable polygonal mirror (polygon mirror), fθ lens, a reflecting mirror and the like. Then, the uniformly charged surface of the photosensitive drum 4 is exposed to the laser light L while being scanned with the laser light L in a main scan direction. By this exposure with the scanning in the main scan direction and movement of the photosensitive drum 4 surface in a sub-scan direction by the rotation of the photosensitive drum 4, the electrostatic latent image corresponding to an exposure pattern is formed on the surface of the rotating photosensitive drum 4. In this embodiment, a potential of an exposed portion on the surface of the photosensitive drum 4 is a light-portion potential VL of about −100 V, and by a potential contrast between the dark-portion potential VD and the light-portion potential VL, the electrostatic latent image corresponding to the exposure pattern is formed.

The electrostatic latent image formed on the surface of the photosensitive drum 4 is developed (visualized) as a toner image by a developing device 7 as a developing means. In this embodiment, the developing device 7 is of a non-magnetic one-component developing type using a toner T as a developer which is a non-magnetic one-component developer. Further, in this embodiment, the developing device 7 effects development by a reversal developing method. That is, the electrostatic latent image is developed into the toner image by depositing the toner, charged to the same polarity as a charge polarity of the photosensitive drum 4, on an exposure portion (light-portion potential portion) lowered in absolute value of electric charge amount by the exposure after the photosensitive drum 4 is uniformly charged. That is, in this embodiment, a normal charge polarity of the toner is negative.

The photosensitive drum 7 includes a developing container 7*a* for containing (accommodating) the toner. The developing container 7*a* is provided with a developing roller 2 as a developer carrying member so as to be partly exposed to the outside thereof from an opening provided at a position where the developing roller 2 opposes the photosensitive drum 4. Specifically, as described later, the developing roller 2 is contactable to the photosensitive drum 4. Further, the developing roller 2 is rotationally driven by a driving motor (not shown) as a driving means, provided to the apparatus main assembly 1, so that a surface of the developing roller 2 moves in the same direction as the surface movement direction of the photosensitive drum 4 at a contact portion where the developing roller 2 contacts the photosensitive drum 4. Further, in the developing container 7*a*, a supplying roller 3 as a developer supplying member for applying the toner T onto the developing roller 2 is provided. The supplying roller 3 is disposed in contact with the developing roller 2. As described later specifically, a surface layer of the supplying roller 3 is formed by a foam layer. Further, the supplying roller 3 is rotationally driven by a driving motor as a driving means, provided to the apparatus main assembly 1, so that a surface of the supplying roller 3 moves in an opposite direction (counter direction) to the surface movement direction of the developing roller 2 at a contact portion where the supplying roller 3 contacts the developing roller 2. Further, in the developing container 7*a*, a rotatable stirring member 7 for stirring the toner T in the developing container 7*a* is provided. Further, to the developing container 7*a*, a developing blade 7*c* as a developer layer thickness regulating member provided in contact with the developing roller 2 is provided.

The developing roller 2 includes a core metal and an electroconductive elastic layer formed around and coaxially with the core metal. The developing roller 2 is disposed so that its rotational axis direction is substantially parallel to the rotational axis direction of the photosensitive drum 4. Further, the developing roller 2 is contactable to and separable from the photosensitive drum 4 and as described later specifically, a contact and separation state thereof is controlled by a contact and separation cam as a contact and separation means provided to the apparatus main assembly 1. During the image formation, the developing roller 2 is rotationally driven in an arrow R2 direction (counterclockwise direction) indicated in FIG. 1 at a predetermined peripheral speed in a state in which the developing roller 2 contacts the photosensitive drum 4.

The toner T is fed toward the supplying roller 3 while being stirred by rotationally driving the stirring member 7*b*. This toner T is applied onto the surface of the developing roller 2 by the supplying roller 3 rotationally rotated in an arrow R3 direction (counterclockwise direction) indicated in FIG. 1 at a predetermined peripheral speed. To the supplying roller 3, a supplying member power source E4 as a supplying member voltage application means is connected. As described later specifically, to the supplying roller 3, as a supplying member voltage (supplying member bias), a predetermined DC voltage is applied during the image formation and a predetermined AC voltage is applied during the detection of the toner amount, from the supplying member power source E4. The developing blade 7*c* regulates the layer thickness of the toner T on the developing roller 2 to carry the toner T on the developing roller 2 as a uniform thin layer and at the same time triboelectrically charges the toner T to provide the toner T with electric charges necessary for the development. In this embodiment, the toner T is charged to the negative polarity. The toner formed in the thin layer on the developing roller 2 is set to a developing area which is an opposing portion to the photosensitive drum 4 by further rotation of the developing roller 2. To the developing roller 2, a developing power source E2 as a developing voltage application means is connected. In this embodiment, during the image formation, to the developing roller 2, a DC voltage of about −300 V as a developing voltage (developing bias) is applied from the developing power source E2. As a result, the toner T sent into the developing area is selectively moved and deposited on the exposed portion (light-portion potential portion) of the electrostatic latent image on the photosensitive drum 4. Thus, the electrostatic latent image on the photosensitive drum 4 is developed as the toner image. Incidentally, as described later specifically, the supplying roller 3 also functions as a detecting member (voltage application member), constituting the developer amount detecting means, for detecting the amount of the toner T in the developing container 7*a*.

On the other hand, a sheet feeding roller 9 is rotationally driven with predetermined control timing, so that a sheet of the recording material S is separated and fed from a sheet feeding cassette 10. The fed recording material S is conveyed through a conveying path 11 to reach a registration roller pair 12, and a leading edge of the recording material S is received at a contact portion (nip) of the registration roller pair 12 which rotation is stopped at that time, thus being subjected to oblique movement correction. Then, the recording material S is fed again by the registration roller pair 12 which is rotationally driven with predetermined control timing to be introduced into a transfer portion (transfer nip) N which is a contact portion between the photosensitive drum 4 and a transfer roller 13 as a transfer means.

The transfer roller 13 includes a core metal and an electroconductive elastic (member) layer formed around and coaxially with the core metal. The transfer roller 13 is disposed so that its rotational axis direction is substantially parallel to a rotational axis direction of the photosensitive drum 4. Further, the transfer roller 13 contacts the photosensitive drum 4 with a predetermined pressure against elasticity of the electroconductive elastic layer to form the transfer portion N between itself and the photosensitive drum 4. The transfer roller 13 is rotated by the rotation of the photosensitive drum 4.

The recording material S is nipped and conveyed at the transfer portion N by the photosensitive drum 4 and the transfer roller 13. To the transfer roller 13, a transfer power source E3 as a transfer voltage application means is connected. During the conveyance of the recording material S through the transfer portion N, to the transfer roller 13, as a transfer voltage (transfer bias), a DC voltage having a predetermined potential and an opposite polarity (positive in this embodiment) to the normal charge polarity of the toner is applied. By applying to the transfer roller 13 the transfer voltage of the opposite polarity to the normal charge polarity of the toner T, at the transfer portion N, electric charges of the opposite polarity to the normal charge polarity of the toner T are provided to the back surface of the recording material S (a surface of the recording material S opposite from the surface facing the photosensitive drum 4). As a result, the toner image on the photosensitive drum 4 is electrostatically transferred onto the surface of the recording material S.

The recording material S coming out of the recording material S is separated from the surface of the photosensitive drum 4 and passes through a conveying path 14 to be introduced into a fixing device 15 as a fixing means. In the fixing device 15, an unfixed toner image on the recording material S is fixed on the recording material S. In this embodiment, the fixing device 15 is a heating roller type and includes a heating roller 15*a* which surface is heated and temperature-controlled to a predetermined fixing temperature and a pressing roller 15*b* for forming a fixing portion (fixing nip) in press-contact with the heating roller 15*a*. The heating roller 15*a* and the pressing roller 15*b* are disposed so that their rotational axis directions are substantially parallel to each other. Each of the heating roller 15*a* and the pressing roller 15*b* is rotationally driven in an arrow direction indicated in FIG. 1 at a predetermined peripheral speed, so that these rollers heat and press the unfixed toner image on the recording material S to fix the unfixed toner image as a fixed image on the recording material S while nip-conveying the recording material S at the fixing portion.

The recording material S coming out of the fixing device 15 is, as an image-formed product, conveyed upward in the apparatus main assembly 1 through a conveying path 16 and then is discharged onto a sheet discharge tray 19 as an upper surface of the apparatus main assembly 1.

Further, the photosensitive drum 4 after the separation of the recording material S therefrom is subjected to removal of a deposited matter, such as the toner (transfer residual toner) deposited on the surface thereof without being transferred onto the recording material S, by the cleaning device 8 as a cleaning means, thus being cleaned. As a result, the photosensitive drum 4 is repetitively subjected to the image formation. In this embodiment, the cleaning device 8 includes a cleaning blade 8*a* as a cleaning member. The cleaning blade 8*a* is contacted to the rotating photosensitive drum 4 so that its free end is directed toward an upstream side (in a counter direction) with respect to the surface movement direction of the photosensitive drum 4 with a predetermined penetration depth (amount). The deposited matter, such as the transfer residual toner, on the photosensitive drum 4 is scraped off from the surface of the rotating photosensitive drum 4 at a contact portion between the edge of the cleaning blade 8*a* and the photosensitive drum 4 and is collected in a residual toner container 8*b*.

2. Process Cartridge

In this embodiment, four process devices consisting of the photosensitive drum 4, the charging roller 5, the developing device 7 and the cleaning device 8 are collectively assembled into a cartridge and an image forming unit which is detachably mountable to the apparatus main assembly 1, thus constituting a process cartridge 20. The process cartridge 20 is detachably mounted to a mounting portion in the apparatus main assembly 1.

As shown in (a) of FIG. 2, in the process cartridge 20, the developing device 7 is rotatably connected to the cleaning device 8 for holding (supporting), together with the cleaning blade 8*a* and the residual toner container 8*b*, the photosensitive drum 4 and the charging roller 5. In a state shown in (a) of FIG. 2, the developing roller 2 and the photosensitive drum 4 contact each other. Then, as shown in (b) of FIG. 2, when a contact and separation cam 30 raises the bottom of the developing device 7, the developing device 7 is rotationally moved upward with a supporting point 33 as a (rotation) center. In a state shown in (b) of FIG. 2, the developing roller 2 and the photosensitive drum 4 are separated (spaced) from each other. As described later specifically, the contact and separation cam 30 is phase-controlled and rotated by controlling a driving motor (not shown) and a solenoid (not shown) by the control circuit portion 101.

The process cartridge 20 is positioned and fixed to a predetermined mounting portion in the apparatus main assembly 1, in a state in which it is mounted to the apparatus main assembly 1, by a positioning and fixing means 28. In that state, from a driving means (not shown) of the apparatus main assembly 1, a driving force to the photosensitive drum 4, a driving force to the developing roller, a driving force to the supplying roller 3 and a driving force to the stirring member are transmittable. Further, in that state, from the power sources E1, E2, E3 and E4 of the apparatus main assembly 1, the voltages are applicable to the charging roller 5, the developing roller 2, the transfer roller 13 and the supplying roller 3, respectively. Incidentally, at an upper surface of the process cartridge 20, an exposure window 20*a* is provided.

Further, the process cartridge 20 is provided with a memory 21 as a storing means and a cartridge-side information transmitting portion 22. In a state in which the process cartridge 20 is mounted in the apparatus main assembly 1, the cartridge side information transmitting portion 22 opposes a main assembly-side information transmitting portion 23 provided at the apparatus main assembly 1 side. As a result, between the memory 21 and the control circuit portion 101, information transfer (information reading and writing) is enabled via the cartridge-side information transmitting portion 22 and the main assembly-side information transmitting portion 23 which constitute a communicating means.

In this embodiment, in the memory 21, lifetime information intrinsic to the process cartridge 20 including information on at least a remaining lifetime amount of the photosensitive drum 4 and a remaining developer amount is stored. This lifetime information can be communicated between the control circuit portion 101 and the memory 21 via the cartridge-side information transmitting portion 22 and the main assembly-side information transmitting portion 23. Then the control circuit portion 101 displays the lifetime information at an operating panel portion (not shown) provided to the apparatus main assembly 1 in real time, so that it is possible to notify a user of the remaining lifetime amount of the process cartridge 20.

3. Developer

In this embodiment, as the developer, the toner T which is a negatively chargeable non-magnetic one-component developer is used. During the development, the toner T is triboelectrically charged negatively, so that cohesion (agglomeration degree) of the toner is 15%. The toner cohesion was measured in the following manner.

As a measuring device, a powder tester (mfd. by Hosokawa Micron Group) including a digital vibration meter ("Model 1332", mfd. by Showa Sokki Corp.) was used. As a measuring method, the following method was used. A 390-mesh sieve, a 200-mesh sieve, and a 100-mesh sieve were superposed and set in the order of narrow aperture, i.e., in the order of the 390-mesh sieve, the 200-mesh sieve, and the 100-mesh sieve from the bottom so that the 100-mesh sieve is located at an uppermost position. On the thus set 100-mesh sieve, 5 g of a sample (toner) which had been accurately weighed was added and then a value of displacement of the digital vibration meter was adjusted at 0.60 mm (peak-to-peak), followed by vibration application for 15 seconds. Thereafter, the weight of the sample remaining on each of the sieves was measured and the cohesion was obtained on the basis of an equation shown below. The measurement sample was left standing for 24 hours before the measurement in an environment of 23° C. and 60% RH and was then subjected to the measurement in the environment of 23° C. and 60% RH.

Cohesion (%)=((remaining sample weight on 100-mesh sieve)/5 g)×100+((remaining sample weight on 200-mesh sieve/5 g)×60+((remaining sample weight on 390-mesh sieve)/5 g)×20

4. Developing Roller

As shown in (a) of FIG. 2, the developing roller 2 includes an electroconductive support 2*a* and a semiconductive elastic rubber layer 2*b*, in which an electroconductive agent is contained, provided around the electroconductive support 1*a*. Specifically, the electroconductive support 2*a* functioning as a core electrode has an outer diameter of 6 mm, and around this electroconductive support 2*a*, the semiconductive silicone rubber layer 2*b* in which the electroconductive agent is added is provided. Further, on the silicone rubber layer 2*b*, as a surface layer, an acrylic urethane rubber layer 2*c* having a thickness of about 20 μm is coated. An outer diameter of the entire developing roller 2 is 12 mm. Further, an electric resistance of the developing roller 2 is $1\times10^6$ ohm. Here, a measuring method of the electric resistance of the developing roller 2 will be described. The developing roller 2 is press-contacted to an aluminum sleeve of 30 mm in diameter with a load of 9.8N. By rotating this aluminum sleeve, the developing roller 2 is rotated at 60 rpm. Then, a DC voltage of −50 V is applied to the developing roller 2. At that time, a resistance of 10 kΩ is provided on a ground side, and a voltage at both ends is measured to calculate a current, so that the electric resistance of the developing roller 2 is calculated. Incidentally, when a volume resistance of the developing roller 2 is larger than $1\times10^9$ ohm, a voltage value of the developing voltage at the developing roller 2 surface is lowered and a DC electric field in the developing area is decreased. As a result, a developing efficiency is lowered and therefore such an inconvenience that an image density is lowered is caused. Therefore, the electric resistance of the developing roller 2 may preferably be not more than $1\times10^9$ ohm.

5. Supplying Roller

In this embodiment, the supplying roller 3 is the developer supplying member and is also a detecting member constituting the remaining developer amount detecting means. As shown in (a) of FIG. 2, the supplying roller 3 includes an electroconductive support 3*b* and a foam layer 3*a* supported by the electroconductive support 3*b*. More specifically, the electroconductive support functioning as a core electrode has an outer diameter of 5 mm, and around this electroconductive support 3*b*, a urethane foam layer 3*a* which is the foam layer having by an open-cell foam (interconnected cell) structure in which air bubbles are connected to each other is provided. The outer diameter of the entire supplying roller 3 including the urethane foam layer 3*a* is 13 mm. By constituting the surface urethane layer as the open-cell foam, the toner can enter the inside of the supplying roller 2 in a large amount. For that reason, it becomes possible to improve a performance of detection of the toner amount described later. Further, the electric resistance of the supplying roller 3 is 1×109 ohm. Here, the measuring method of the resistance of the electric supplying roller 3 will be described. The supplying roller 3 is press-contacted to the aluminum sleeve of 30 mm in diameter so that an entering amount (penetration depth) described later is 1.5 mm. By rotating this aluminum sleeve, the supplying roller 3 is rotated at 30 rpm. Then, to the supplying roller 3, the DC voltage of −50 V is applied. At that time, a resistance of 10 kΩ is provided on the ground side and the voltage at both ends is measured to calculate the current, so that the electric resistance of the supplying roller 3 is calculated. A surface cell diameter of the supplying roller 3 was 50 μm to 1000 μm. Here, the "cell diameter" means an average diameter of the foam cell at an arbitrary cross section. A maximum area of the foam cell is measured from an enlarged image at the arbitrary cross section and is converted into an equivalent perfect circle diameter to obtain the maximum cell diameter. A portion of the foam cell which is ½ or less of the maximum cell diameter is deleted as noise and thereafter individual cell diameters are obtained by converting individual cell areas of a remaining portion of the foam cell, so that the above-described average diameter is obtained as an average of the individual cell diameters.

Further, the supplying roller 3 had a surface air flow amount of 1.8 liters/minute or more.

Here, the "surface air flow amount" of the supplying roller 3 will be described. Part (a) of FIG. 3 is a schematic view for illustrating the measuring method of the surface air flow amount.

First, the supplying roller 3 is inserted into a measuring jig 43 as shown in (b) of FIG. 3. The measuring jig 43 is prepared by providing a through hole of 10 mm in diameter which penetrates through a side surface of a hollow cylindrical member so that a center axis of the through hole and an axis of the cylinder of the hollow cylindrical member are perpendicular to each other. An inner diameter of the hollow cylindrical member used is 1 mm smaller than the outer diameter of the supplying roller 3 to be measured. This is because a gap between the inner surface of the hollow cylindrical member of the measuring jig 43 and the outer surface of the supplying roller 3 to be measured is eliminated. The supplying roller 3 in this embodiment has the outer diameter of 13 mm and therefore the inner diameter of the hollow cylindrical member of the measuring jig 43 is 12 mm. The measuring jig 43 in which the supplying roller 3 has been inserted is attached to a ventilation holder 44 as shown in (c) of FIG. 3. The ventilation holder 44 has a substantially T-like shape such that a hollow cylindrical member 44*a* is connected at its side surface to a connecting pipe 44*b* to which a ventilation pipe 45 communicating with a pressure reducing pump 48 is to be attached, and has such a shape that a portion opposite from the connected portion of the connecting pipe 44*b* has been considerably cut away. The inner diameter of the connecting pipe 44*b* is set so as to be larger than the diameter of the through hole of the measuring jig 43. In this embodiment, the inner diameter of the connecting pipe 44*b* was set at 12 mm. The inner diameter of the hollow cylindrical member 44*a* of the ventilation holder 44 has the substantially same dimension as the outer diameter of the measuring jig 44, so that the measuring jig 43 can be inserted into the hollow cylindrical member 44*a* of the ventilation holder 44. As shown in (a) of FIG. 3, one end of the through hole of the measuring jig 43 is entirely exposed to the cut-away portion of the hollow cylindrical member 44*a* of the ventilation holder 44, and the other end of the through hole of the measuring jig 43 is provided substantially opposed to the inner diameter portion of the connecting pipe 44*b*.

On left and right sides of the hollow cylindrical member 44*a* of the ventilation holder 44, as shown in (a) of FIG. 3, acrylic pipes 42*a* and 42*b* each of which is connected to the hollow cylindrical member 44*a* at one end and is stopped up at the other end are provided. The supplying roller 3 extending from each of left and right ends of the measuring jig 43 is accommodated in the acrylic pipe 42*a* and 42*b*.

At intermediate portions of the ventilation pipe 45, a flow meter 47 ("KZ Type Air Permeability Tester", mfd. by Daiei Kagaku Seiki Mfg. Co., Ltd.) and a different pressure control valve 46 are provided. Connecting portions of the measuring jig 43, the ventilation holder 44, the ventilation pipe 45 and the acrylic pipes 42*a* and 42*b* are sealed with a tape or grease. This is because when the inside air of the ventilation pipe 45 is evacuated by a pressure reducing pump 48, the ambient air is prevented from entering the inside of the ventilation pipe 45 through a portion except the through hole of the exposed measuring jig 43.

The "surface air flow amount" is measured in the following manner. First, referring to (a) of FIG. 3, in a state in which the supplying roller 3 is not disposed, the pressure reducing pump 48 is actuated and the pressure is adjusted by the differential pressure control valve 46 so that a measured value of the flowmeter 47 is stable and is 10.8 liters/min. Thereafter, the supplying roller 3 which is an object to be measured is disposed and is carefully sealed as described above, and then the measured value of the flowmeter 47 under the same evacuation condition as that described above is taken as the "surface air flow amount". The "surface air flow amount" is taken as a value at the time when the measured value of the flowmeter 47 is sufficiently stabilized. The air flow which will pass through the supplying roller 3 enters the urethane foam layer 3*a*, located at the through hole when the measuring jig 43 is exposed, from the surface of the urethane foam layer 3*a* and passes through the inside of the urethane foam layer 3*a* and then comes outs of the surface of the urethane foam layer 3*a* located at the other-side through hole of the measuring jig 43. The surface of the urethane foam layer 3*a* of the supplying roller 3 in general is different from the inside of the urethane foam layer 3*a* in many cases. For example, in the case where the supplying roller 3 is formed by in-mold foaming, a skin layer different in surface cell aperture ratio from the inside can appear at the surface. Further, the urethane foam layer 3*a* which has the surface which has not been formed simply as a cylindrical surface but has been intentionally provided with projections and recesses is also present. The toner powder fluid which enters and comes out of the inside of the urethane foam layer 3*a* can be influenced by the above-described surface state, so that behavior thereof cannot be grasped only by measurement of bulk air flow amount as defined in JIS-L 1096. Therefore, in this embodiment, the above-described air flow amount measuring method for measuring the air flow which enters and comes out of the surface of the urethane foam layer 3*a* as described above is employed and the measured air flow amount is used as a principal parameter for creating an equilibrium state of the toner powder fluid (or a state close thereto).

The developing roller 2 is rotationally driven in the direction indicated by the arrow R2 in FIG. 1 and the supplying roller 3 is rotationally driven in the direction indicated by the arrow R3 in FIG. 1. A distance between rotation centers (axes) of the developing roller 2 and the supplying roller 3 is set at 11 mm. With respect to hardness of the urethane foam layer 3*a* of the supplying roller 3, the urethane foam layer 3*a* is sufficiently softer than the silicone rubber layer 2*b* and the acrylic urethane rubber layer 2*c* of the developing roller 2. For that reason, the surface of the developing roller 2 contacts the supplying roller 3 in a state in which the urethane foam layer 3*a* is deformed by 1.5 mm at the maximum. This maximum deformation amount is referred to as the entering amount (penetration depth) of the developing roller 2 with respect to the supplying roller 3. The rotational speed of the developing roller 2 is 300 rpm and the rotational speed of the supplying roller 3 is 240 rpm. With the rotation of the developing roller 2 and the supplying roller 3, the urethane foam layer 3*a* of the supplying roller 3 is deformed by the developing roller 2 at the contact portion therebetween. At this time, the toner T held in the surface layer of or inside the urethane foam layer 3*a* of the supplying roller 3 is discharged from the surface layer of the urethane foam layer 3*a* and a part thereof is transferred onto the surface of the developing roller 2. The toner which is transferred on the surface of the developing roller 2 is regulated by a regulating blade 5 which is a developer regulating member and is provided downstream of the contact portion, between the developing roller 2 and the supplying roller 3, with respect to the rotational direction of the developing roller 2 while contacting the developing roller 2, thus being formed in a uniform layer. In the above process, the toner T is rubbed at the contact portion between the developing roller 2 and the supplying roller 3 or at the contact portion between the developing roller 2 and the regulating blade 7*c*, thus obtaining desired triboelectric charges (negative charges in this embodiment). Further, the developing roller 2 and the supplying roller 3 are rotated so that their surfaces move in the opposite directions at their contact portion, with the result that the toner (development residual toner) remaining on the developing roller 2 without being consumed for the development is removed from the developing roller 2 by the supplying roller 3.

6. Contact and Separation Operation Between Developing Roller and Photosensitive Drum As shown in (a) and (b) of FIG. 2, a contact and separation operation between the developing roller 2 and the photosensitive drum 4 is performed by effecting a rotational movement operation of the developing device 7 by the contact and separation cam 30 provided at the apparatus main assembly 1 side. The contact and separation cam 30 performs the rotation operation by controlling the driving motor (not shown) and the solenoid (not shown) by the control circuit portion 101.

From the state shown in (a) of FIG. 2 in which the developing roller 2 and the photosensitive drum 4 contact each other, when the contact and separation cam 30 raises the bottom of the developing device 7 by its rotation, the developing device 7 is rotationally moved upward with the supporting point 33 as the (rotation) center. As a result, as shown in (b) of FIG. 2, the developing roller 2 and the photosensitive drum 4 are in a separated (spaced) state.

Here, the developing roller 2 and the photosensitive drum 4 are connected so that their bearing members (not shown) are connected with each other by a spring member 32 as an urging means. When the developing roller 2 and the photosensitive drum 4 are contacted to each other, these members are held in a contacted state by an urging force of this spring member 32. For that reason, in the case where the developing device 7 is a direction in which the developing roller 2 is separated (spaced) from the photosensitive drum 4, the developing device 7 is moved against a tension of the spring member 32. At this time, a force for moving upward the cleaning device 8 which holds the photosensitive drum 4 is exerted but a fixing means (mounting/demounting guide member) 28 (FIG. 1) provided at the apparatus main assembly 1 side is abutted against the upper surface of the cleaning device 8, so that movement of the cleaning device 8 is prevented.

On the other hand, in the case where the contact and separation cam 30 is rotated from a position where it raises the developing device 7 to a position where it does not contact the developing device 7, the developing device 7 is rotationally moved downward with the supporting point 33 as the center. As a result, as shown in (a) of FIG. 2, the developing roller 2 and the photosensitive drum 4 are in a contacted state. At this time, the developing device 7 is moved by its own weight and the tension of the spring member 32, so that the developing roller 2 and the photosensitive drum 4 are held in the contacted state by the tension of the spring member 32.

In this embodiment, the contact and separation cam 30 is controlled by the driving motor and the solenoid, which are provided at the apparatus main assembly 1 side, so as to be rotated by a half-turn every operation. Every half-turn of the contact and separation cam 30, a switching between an image forming state (contact position) and a stand-by state (separated position) is repeated. Further, at the apparatus main assembly 1 side, a phase detecting sensor (not shown) for detecting a phase of the contact and separation cam 30 is provided. The control circuit portion 101 controls the phase of the contact and separation cam 30 by controlling the driving motor and the solenoid depending on a detection result of the phase detecting sensor.

Here, the state where the developing roller 2 and the photosensitive drum 4 are contacted to each other is taken as a first position ((a) of FIG. 2) of the developing device 7. On the other hand, the state where the developing roller 2 and the photosensitive drum 4 are separated from each other is taken as a second position ((b) of FIG. 2) of the developing device 7. In this embodiment, when the developing device 7 is located at the second position an electrostatic capacity between the developing roller 2 and the supplying roller 3 is detected, so that the toner amount in the developing container 7*a* can be detected.

7. Toner Amount Detecting Method

Next, a toner amount detecting method utilizing a change in electrostatic capacity in this embodiment will be described.

FIG. 4 shows a voltage applying system to the developing device 7 located at the second position. FIG. 5 shows a connection embodiment of various electric contacts in a state where the developing device 7 is provided in the apparatus main assembly 1.

As shown in FIG. 5, a first developing device contact electrode 85 electrically connected to the core metal electrode (electroconductive support) 2*a* of the developing roller 2 is provided to the developing device 7. Further, a first main assembly contact electrode corresponding to the first developing device contact electrode 85 is provided on the apparatus main assembly 1 side. The first main assembly contact electrode 86 is connected to an electrostatic capacity detecting device (detector) 82 as an electrostatic capacity detecting means constituting a developer amount detecting (detecting device) provided inside the apparatus main assembly 1 and is connected to the developing power source E2 (FIG. 4). Further, second developing device contact electrode 83 electrically connected to the core electrode (electroconductive support) 3*a* of the supplying roller 2 is provided to the developing device 7. Further, a second main assembly contact electrode 84 corresponding to the second developing device contact electrode 83 is provided on the apparatus main assembly 1 side. The second main assembly contact electrode 84 is connected with a detecting voltage output portion 80*a* (FIG. 4) constituting the developer amount detecting means and with a supply voltage output portion 80*b* (FIG. 4) which are provided in the supplying member power source E4 inside the apparatus main assembly 1.

The supply voltage output portion 80*b* may also be a power source capable of applying both of positive and negative DC voltages to the supplying roller 3. In the state in which the developing device 7 is mounted at a predetermined position in the apparatus main assembly 1, the contact electrodes 85 and 86 are electrically connected to each other and the contact electrodes 83 and 84 are electrically connected to each other even when the developing device 7 is located at either of the first position and the second position. That is, even when the developing device 7 is swung between the first position and the second position, the first developing device contact electrodes 85 and the first main assembly contact electrode 86 still contact each other and the second developing device contact electrodes 83 and the second main assembly contact electrode 86 still contact each other.

During a normal developing operation, the developing device 7 is located at the first position and the DC voltage of about −300 V is applied, as the developing voltage, from the developing power source E2 to the developing roller 2 through the first main assembly contact electrode 86 and the first developing device contact electrode 85. At this time, the voltage is not supplied from the detecting voltage output portion 80*a* but is supplied from only the supply voltage output portion 80*b*, so that the DC voltage of about −300 V which is substantially equal to the developing voltage is applied to the supplying roller 3. That is, during the developing operation, the detector 82 and the detecting voltage output portion 80*a* are switched to the developing power source E2 and the supply voltage output portion 80*b* of the supplying member power source E4.

During a non-image forming operation, the developing device 7 is located at the second position and in this embodiment, to the core electrode 3*b* of the supplying roller 3, a detecting voltage is applied from the detecting voltage output portion 80*a* of the supplying member power source E4, so that the detection of the amount of the toner in the developing container 7*a* is made.

As the detecting voltage, an AC voltage of 50 kHz in frequency f and 200 V in peak-to-peak voltage (Vpp) is used. At this time, the supply voltage output portion 80*b* of the supplying member power source E4 and the developing power source E2 do not supply the voltage. As a result, in the core electrode 2*a* of the developing roller 2, a voltage is induced by the detecting voltage and is detected by the detector 82.

As described above, during the non-image formation, more specifically, when the developing operation is not performed, the developing device 7 is located at the second position, i.e., is placed in the state in which the photosensitive drum 4 and the developing roller 2 are spaced from each other. More specifically, the toner amount detection can be realizing, e.g., in the following periods as during the non-image formation. First, the period is a period (sheet interval) corresponding to an area, on the photosensitive drum 4, between sheets of the recording material S during continuous image formation on a plurality of sheets of the recording material S. Further, the period is during a preparatory operation (pre-rotation operation) before start of the image forming step. Further, the period is a period of an apparatus operation (post-rotation operation) from completion of the image forming operation to discharge of the recording material S from the image forming apparatus to the outside of the image forming apparatus. In the case where the developing device 7 is located at the second position, the photosensitive drum 4 and the developing roller 2 are spaced from each other and therefore even when the AC voltage is applied to the supplying roller 3 as detecting voltage, there is no occurrence of white background contamination which is called fog. Further, there is also no occurrence of impact noise generated, in the case where the developing roller 2 and the photosensitive drum 4 contact each other, by vibration such that they impact each other. Further, the developing roller 2 is used as an antenna for electrostatic capacity detection by applying an AC voltage, for the purpose of detecting the toner amount, to the core electrode 3*b* of the supplying roller 3, so that it is possible to prevent toner conveyance inhibition which can occur in a constitution in which a separate antenna is provided in the developing device. Incidentally, as shown in (a) and (b) of FIG. 2, by moving of the developing device 7 between the first position and the second position, the attitude of the developing device 7 is changed and correspondingly the toner T in the developing container 7*a* is somewhat moved.

However, the amount of the toner contained in the supplying roller 3 is not changed. That is, the amount of the toner present between the developing roller 2 and the supplying roller 3 is not changed, so that output of the voltage induced in the developing roller 2 is not changed. Specifically, the supplying roller 3 includes the foam layer which permits entry of the toner into the inside of the foam layer and thus the toner in the foam layer is less liable to move even when the attitude of the developing device 7 is changed, so that the output of the voltage is not changed. In addition, in this embodiment, when the remaining toner amount detection utilizing the electrostatic capacity is performed in the state in which the developing roller 2 and the photosensitive drum 4 are spaced from each other, the drive of the developing roller 2 and the supplying roller 3 is stopped. By stopping the drive of the developing roller 2 and the supplying roller 3, the toner supply to the developing roller 2 and the removing operation of the development residual toner interrupted. For that reason, the amount of the toner contained in the supplying roller 3 is constant during the toner amount detection, so that accuracy of the toner amount detection can be enhanced.

FIG. 6 shows a basic operation flow of the toner amount detecting method as described above. In an example illustrated in FIG. 6, timing when the toner amount detection is during a so-called post-rotation operation after the end of the image forming operation. When the image forming operation is ended, a spacing operation between the photosensitive drum 4 and the developing roller 2 is performed by moving the developing device 7 from the first position to the second position. Thereafter, the drive of the developing roller 2 and the supplying roller 3 is stopped. Thereafter, the detecting voltage is applied, so that the toner amount detection is performed.

According to the toner amount detecting method as described above, the influence of the electrostatic capacity generated between the photosensitive drum 4 and the developing roller 2 is eliminated, so that the toner amount detection accuracy can be improved. Further, as described above, the detecting voltage is applied only during the attitude in which the developing roller 2 and the photosensitive drum 4 are spaced from each other and therefore it is also possible to prevent the occurrence of fog image and the occurrence of the impact noise due to the vibration between the photosensitive drum 4 and the developing roller 2.

8. Toner Amount Detection Accuracy

Next, the toner amount detection accuracy by the above-described toner amount detecting method will be described in detail.

Part (a) of FIG. 7 shows a relationships between the amount of the toner in the developer container 7*a* and the amount of the toner contained in the supplying roller 3. Incidentally, (a) of FIG. 7 is an experimental result of the following measurement. That is, the toner T was filled in the developing device 7 in this embodiment and was gradually consumed. Then, after the electrostatic capacity was measured at each of different remaining toner amounts, the supplying roller 3 was taken out and the amount of the toner T contained in the supplying roller 3 (a difference in weight from the supplying roller 3 before use) was measured. As shown in (a) FIG. 7, it is understood that the toner amount in the developing container 7*a* and the amount of the toner contained in the supplying roller 3 are changed while keeping a good correlation which is relatively linear. Part (b) of FIG. 7 shows, in the above measurement, a check result of a relationship between an output value of the electrostatic capacity and the amount of the toner contained in the supplying roller 3 at that time. As shown in (b) of FIG. 7, it is understood that the amount of the toner contained in the supplying roller 3 and the electrostatic capacity output value keep a very good correlation which is substantially linear. This shows that on the basis of the change in electrostatic capacity depending on the change in amount of the toner contained in the supplying roller 3, the amount of the toner in the process cartridge 7*a* can be accurately measured by the toner amount detecting method as described above.

Here, with an increasing surface air flow amount in the supplying roller 3, there is a tendency that an absolute value of the electrostatic capacity detection output value is increased. When the supplying roller 3 has the surface air flow amount of 1.8 liters/min. or more, a correlation between the electrostatic capacity output value and the toner amount in the developing container 7*a* is good, so that the detection accuracy of the toner amount is further enhanced. Further, when the surface air flow amount of the state 3 is large, a pore portion of the foam layer of the supplying roller 3 is increased and a strength of the supplying roller 3 is decreased, so that the foam layer of the supplying roller 3 is liable to broken. In order to prevent the breaking of the foam layer, the surface air flow amount of the supplying roller 3 may preferably be 5.0 liters/min. or less. That is, the range of the surface air flow amount of the supplying roller 3 may preferably be from 1.8 liters/min. to 5.0 liters/min. (i.e., $1.8 \leq L \leq 5.0$ where L is the surface air flow amount (liters/min.)).

Incidentally, the toner T in the supplying roller 3 is partly discharged when the supplying roller 3 is started to be deformed at the time of start of the contact of the rotating supplying roller 3 with the developing roller 2. Further, the toner T in the supplying roller 3 is partly inhaled when the deformation of the supplying roller 3 is eliminated (i.e., the deformed shape of the supplying roller 3 is returned to the original shape) at the time of end of the contact of the supplying roller 3 with the developing roller 2. Thus, the toner T enters and comes out of the supplying roller 3 but the amount of the toner in the supplying roller is generally kept in the equilibrium state unless the toner amount in the developer container 7*a* is changed. Experimental data shown in (a) and (b) of FIG. 7 are measurement results in a state in which the coming and going of the toner T with respect to the supplying roller 3 is kept in the equilibrium state. Further, in order to measure the above-described electrostatic capacity output value with high accuracy when the amount of the toner in the supplying roller 3 is judged more properly, as described above, the output value may preferably be measured after the rotation of the supplying roller 3 is stopped so as not to cause the entry of the toner into the supplying roller 3 and the exit of the toner from the supplying roller 3.

Here, the correlation shown in (a) of FIG. 7 between the toner amount in the developing container 7*a* and the amount of the toner contained in the supplying roller 3 depends on the cohesion (agglomeration degree) of the toner T. With a lower cohesion, the entry and exit of the toner with respect to the supplying roller 3 become easy, so that it is considered that the correlation between the toner amount in the developing container 7*a* and the amount of the toner contained in the supplying roller 3 becomes good. When the image forming operation was performed in the image forming apparatus 100 in this embodiment and the cohesion of the toner T left in the developing container 7*a* in a state in which the toner T in the developing container 7*a* was sufficiently consumed was measured, the cohesion was 30%. Generally, with a higher frequency of the use of the toner T in the developing container 7*a*, there is a tendency that the cohesion of the toner T is made higher, so that the cohesion of the toner T in the developing container 7*a* before the image forming operation is performed can be estimated that it is lower than 30%. In other words, when the toner having the cohesion of 30% or less can be preferably used for creating the state in which the entry of the toner into the supplying roller 3 and the exit of the toner from the supplying roller 3 are in the equilibrium state. Incidentally, in this embodiment, the constitution in which the detector 82 for detecting the voltage induced in the developing roller 2 by applying the detecting voltage to the supplying roller 3 was disposed was employed. However, the present invention is not limited thereto but may also employ a constitution in which a detector for detecting the voltage is induced in the supplying roller 3 by applying the detecting voltage to the developing roller 2 is disposed, so that an effect similar to that in this embodiment can be obtained.

9. Improvement in Toner Amount Detection Accuracy

As described above, the amount of the toner contained in the supplying roller 3 is detected as the electrostatic capacity and is associated with the toner amount in the developing container 7*a* in advance, it is possible to detect the toner amount in the developing container 7*a*.

However, in the case where an image with a high print ratio such as a solid (image of a maximum density level) is continuously formed, a balance of the above-described entry and exit of the toner T with respect to the supplying roller 3 is destroyed from the equilibrium state, so that the amount of the toner contained in the supplying roller 3 is temporarily decreased. Correspondingly, the electrostatic capacity between the supplying roller 3 and the developing roller 2 is also temporarily decreased and therefore the detection result of the toner amount can be derived from an actual toner amount in the developing container 7*a*.

Actually, as shown in (a) of FIG. 8, in the case where the image formation is performed at the print ratio of 0% under a condition in which the toner amount in the developing container 7*a* is a predetermined value, there is no toner consumption and therefore the amount of the toner contained in the supplying roller 3 is kept in the equilibrium state. On the other hand, in the case where the continuous image formation of a so-called solid image with the print ratio of 100% is effected, the amount of the toner contained in the supplying roller 3 is largely changed. This suggests that there is a possibility that the amount of the toner contained in the supplying roller 3 is temporarily in an exhausted state immediately after the image with the high print ratio is formed and there is a possibility that the toner amount is erroneously detected, so as to smaller than the actual toner amount in the developing container 7*a* in the case where the toner amount detecting operation is performed in the exhausted state.

However, in the case where the image with the print ratio of 100% ("100%") is similarly formed continuously and then the image formation is switched to the image formation with the print ratio of 0% ("0%) at the time indicated by an arrow X in (a) of FIG. 8, the state of the amount of the toner contained in the supplying roller 3 is restored to the state indicated by an arrow Y in (a) of FIG. 8. This shows status of the following change of the toner amount state. That is, first, by the continuous formation of the solid image, the amount of the toner contained in the supplying roller 3 is temporarily decreased. However, by performing the rotation operation in the state of the print ratio of 0%, the toner T is supplied into the supplying roller 3, so that the state of the amount of the toner contained in the supplying roller 3 is restored to the equilibrium state.

Therefore, in this embodiment, the toner amount detection accuracy is intended to be improved by performing a toner supplying operation described below specifically.

FIG. 9 shows a schematic control block diagram of the toner amount detecting operation in this embodiment. A pixel number measure means 104 (measuring portion) of the control circuit portion 101 measures the pixel number (print pixel number) of the image, to be formed, on the basis of the image data sent from the external host device 200. Then, the pixel number measuring means 104 calculates an average print ratio P at each page in a job (a series of image forming operations on a single sheet of or a plurality of sheets of the recording material in accordance with a single image formation start instruction).

Incidentally, the average print ratio P can be calculated from a proportion of an integrated value of density information at each pixel in an associated page to an integrated value (total), taken as 100%, of the density information at each pixel for one page in the case where the image segments at all of the pixels in an image formable area corresponding to one page are the solid image. The image density information is information indicating that the density level at each pixel is which level of, e.g., 256 gradation levels from 0 to 255. The image density information and the toner amount per unit area are associated with each other in advance and therefore the integrated value of the density information at each pixel for one page corresponds to a toner consumption (amount) for the associated one page.

Next, a computing means 105 of the control circuit portion 101 computes a toner content Wm in the supplying roller 3, which is an index of the amount of the toner contained in the supplying roller 3 immediately after the job, from the calculated average print ratio P for each page.

Here, the toner content Wm is defined as 100% in the state in which the balance of the entry and exit of the toner T with respect to the supplying roller 3. The computing means 105 calculates, on the basis of the information on the average print ratio P, the toner content Wm as a deviation amount from that in the equilibrium state with respect to the amount of the toner contained in the supplying roller 3.

Specifically, the computing means 105 performs the following computation with respect to the toner content Wm immediately after job in which the images for m pages are continuously formed.

$$Wm=W(m-1)\times(1+Km\times10^{-3})$$

In the above, a coefficient Km is a fluctuation (increase and decrease) coefficient determined depending on a toner content W(m−1) immediately after image formation on (m−1)-th page and an average print ratio Pm on m-th page, and can be associated in advance as shown in Table 1.

TABLE 1

| | Toner content in supplying roller W (m − 1) (%) | | | |
|---|---|---|---|---|
| Pm (%) | 100 ≥ W (m − 1) ≥ 95 | 95 > W (m − 1) ≥ 90 | 90 > W (m − 1) ≥ 80 | 80 > W (m − 1) ≥ 0 |
| 100 ≥ Pm ≥ 95 | −10 | −5 | 0 | 0 |
| 95 > Pm ≥ 90 | 5 | −2 | 0 | 0 |
| 90 > Pm ≥ 50 | −2 | 0 | 0 | 2 |
| 50 > Pm | 0 | 0 | 2 | 4 |

Specifically, the relationship shown in Table 1 is based on experimental data obtained by checking the increase and decrease of the toner content depending on the print ratio of the image to be continuously formed. For example, as shown in (c) of FIG. 8, by obtaining the change of the toner content per (one) page in the case where the so-called image with the print ratio of 100% ("100%" in the figure), the relationship as shown in Table 1 can be set in advance. Further, assuming that the state of the amount of the toner contained in the supplying roller 3 immediately before the image forming operation is kept in the equilibrium state, a toner content W0 is defined as W0=100%. The computing means 105 successively calculates the toner content Wm for each page in the job by using the information on the relationship as shown in Table 1, thus finally obtaining the toner content Wm at the time of the end of the job.

In the case where the toner content Wm is detected that it is smaller than 100%, the control circuit portion 101 restores the state of the amount of the toner contained in the supplying roller 3 to the equilibrium state by a toner supplying means 106 (supplying device) and thereafter executes the toner amount detection be operating a toner amount detecting means 107. This is because in this case, the state of the amount of the toner contained in the supplying roller 3 is predicted as being a temporarily exhausted state. The toner detecting operation to the supplying roller 3 by the toner supplying means 106 can be realized by controlling the rotation number (the number of turns) of the supplying roller 3 during the so-called post-rotation operation after the image formation. That is, in this embodiment, the toner amount detecting means 107 as the developer amount detecting means is constituted by the developing roller 2, the supplying roller 3, the detector 82, the supplying member power source E4 (the detecting voltage output portion 80*a*) and the like.

Specifically, the control circuit portion 101 obtains the number of rotations (turns) of the supplying roller 3, as the toner supplying operation, required until the toner content reaches that (100%) in the equilibrium state. In this embodiment, e.g., as shown in Table 2, information on a relationship between the toner content Wm and the rotation number of the supplying roller 3 is set in advance in the control circuit portion 101. The control circuit portion 101 obtains, by using the information on the relationship as shown in Table 2, the rotation number of the supplying roller 3 necessary for the toner detecting operation depending on the toner content Wm calculated by the computing means 105, thus controlling the rotation drive operation of the supplying roller 3 performed before the toner amount detecting operation.

TABLE 2

| Wm (%) | TRO*1 |
|---|---|
| Wm = 100 | 0 |
| 100 > Wm ≥ 95 | 18 |
| 95 > Wm ≥ 90 | 25 |
| 90 > Wm ≥ 80 | 31 |
| 80 > Wm ≥ 37 | 37 |

*1"TRO" represents the toner supplying operation (rotation number).

Here, the relationship shown in Table 2 is based on experimental data obtained, as shown in (b) of FIG. 8, by checking a relationship between the toner content and the rotation number of the supplying roller 3 required until the toner content reaches that (100%) in the equilibrium state. Specifically, (b) of FIG. 8 shows a result of measurement of a toner filling ratio of the supplying roller 3 while continuously effecting the image formation with the print ratio of 0% after the supplying roller 3 containing no toner T is disposed. This results shows a state in which the toner T is supplied by rotationally the supplying roller 3 and thus the toner content reaches that in the equilibrium state. Thus, the control circuit portion 101 executes the rotational drive of the supplying roller 3, as the toner supplying operation, by a necessary rotation number obtained depending on the toner content Wm before the toner amount detecting operation is executed during the post-rotation operation. As a result, when the toner amount detecting operation is executed, the state of the amount of the toner contained in the supplying roller 3 can be always in the equilibrium state and therefore good toner amount detection accuracy can be obtained. Incidentally, in the image forming apparatus 100 in this embodiment, when the supplying roller 3 is rotated, the developing roller 2 is also rotated.

FIG. 10 shows a flow of a series of operations of the image forming apparatus 100 including the image forming operation, the toner supplying operation and the toner amount detecting operation in this embodiment.

When the image forming apparatus 100 is in a print standby state, a print signal is inputted from the external host device 200 into the control circuit portion 101 (S101). Thereafter, the control circuit portion 101 starts the image forming operation (S102). Thereafter, the pixel number measuring means 104 of the control circuit portion 101 measures the pixel number of the image to be formed on the basis of image data sent from the external host device 200, so that the average print ratio P for each page in the job is calculated (S103). Then, the computing means 105 of the control circuit portion 101 calculates, on the basis of the average print ratio P for each page calculated from the measurement result of the pixel number, the toner content Wm immediately after the job in which the images for m pages are continuously formed (S104). When the image formation is ended (S105), the control circuit portion 101 moves the developing device 7 from the first position to the second position by the spacing means 30 (S106). Next, the control circuit portion 101 judges whether or not the toner content Wm calculated in S104 reaches that in the equilibrium state (whether or not Wm<100 (%)) (S107).

In S107, in the case where the amount of the toner contained in the supplying roller 3 is judged as being in the equilibrium state (Wm=100(%)), the control circuit portion 101 stops the developing roller 2 and the supplying roller 3 (S109) and then executes the toner amount detecting operation (S110). On the other hand, in S107, the amount of the toner contained in the supplying roller 3 is judged as being in the exhaust state (Wm<100(%)), the control circuit portion 101 executes the toner supplying operation (S108). That is, the control circuit portion 101 obtains, from the toner content Wm calculated in S104, the necessary rotation number of the supplying roller 3 on the basis of the table as shown in Table 2 and then rotationally drives the developing roller 2 and the supplying roller 3 on the basis of the result. Thereafter, the control circuit portion 101 stops the developing roller 2 and the supplying roller 3 (S109) and then executes the toner amount detecting operation (S110).

Thus, the image forming apparatus 100 in this embodiment includes the developer amount detecting means 107 for detecting the developer amount in the developing container by detecting the electrostatic capacity between the developer carrying member 2 and the developer supplying member 3 during the non-image formation. Further, the image forming apparatus 100 includes the computing means 105 for predicting (estimating) the amount of the developer contained in the developer supplying member 3 after the image formation, and the supplying means 106 for supplying the developer into the developer supplying member 3 until the detection by the developer amount detecting means 107 is executed after the image formation. Further, the supplying means 106 increases the amount of the developer to be supplied into the developer supplying member 3 with a smaller amount of the developer contained in the developer supplying member 3 estimated by the computing means 105. In this embodiment, the computing means 105 estimates the amount of the developer, contained in the developer supplying member 3 after the image formation, from information of the amount of the developer used for the formed image (from the average print ratio in this embodiment). Further, in this embodiment, the supplying means 106 increases the rotation number of the developer supplying member 3, in a period from after the image formation until the detection by the developer amount detecting means 107 is executed, with a smaller amount of the developer contained in the developer supplying member 3 estimated by the computing means 105. As a result, the amount of the developer supplied into the developer supplying member 3 is increased.

As described above, according to this embodiment, the pixel number of the image to be formed is measured and the temporary toner content of the supplying roller 3 immediately after the image formation is estimated by the computation. Then, depending on the estimated toner content, an optimum toner supplying operation is performed and then the toner amount detecting operation is performed. For that reason, it is possible to detect the toner amount in the developing container 7*a* with high accuracy. Further, the toner content is estimated on the basis of the pixel number of the image to be formed and therefore it is possible to obtain a good toner amount detection accuracy by performing a necessary minimum toner supplying operation depending on the image to be formed. For that reason, the toner amount detection accuracy can be improved without shortening the lifetime of the developing device 7 and lowering productivity of image formation which are caused due to abrasion or the like of the toner T or parts such as the developing roller 2 and the supplying roller 3.

Incidentally, in this embodiment, the toner content Wm and the rotation number of the supplying roller 3 during the post-rotation operation necessary before the execution of the toner amount detecting operation were stepwisely associated as shown in Table 2. However, the rotation number of the supplying roller 3 may also be computed more specifically by using a mathematical expression in the computing means 105 and typically may be computed so that it can be substantially changed continuously. Further, in order to execute in a shorter time the toner supplying operation necessary until the amount of the toner contained in the supplying roller 3 reaches that in the equilibrium state, it is also possible to increase the rotational speed of the supplying roller 3 during the toner supplying operation. In this case, the time of the post-rotation operation can be shortened without impairing the toner amount detection accuracy, so that the operation can be quickly transferred to a subsequent image forming operation and therefore the increase of the rotational speed is advantageous also from the viewpoint of the productivity of image formation. Further, the good toner amount detection accuracy can be obtained by the necessary minimum drive of the developing device 7 during the post-rotation operation and therefore the increase of the rotational speed is advantageous also from the viewpoint of the lifetime of the developing device affected by the abrasion or the like of the toner T or the parts such as the developing roller 2 and the supplying roller 3.

Embodiment 2

Next, another embodiment of the present invention will be described. A basic constitution and operation of an image forming apparatus in this embodiment are the same as those in Embodiment 1. Therefore, elements (means) identical or corresponding to those in Embodiment 1 are represented by the same reference numerals or symbols and will be omitted from detailed description.

In this embodiment, the pixel number measuring means 104 of the control circuit portion 101 more specifically measures the print ratio of each of areas obtained by dividing the image area of the image to be formed for the associated page into a plurality of the areas. Further, on the basis of a measurement result of the print ratio, the computing means 105 of the control circuit portion 101 calculates the toner content immediately after the image formation for each of the divided areas. Thus, on the basis of the thus obtained toner content, the rotation number of the supplying roller 3 during the post-rotation operation necessary before the execution of the toner amount detection operation is controlled. This will be described below more specifically.

In this embodiment, the pixel number measuring means 104 of the control circuit portion 101 divides, as shown in FIG. 11, the image area of the image to be formed for the associated page into the plurality of areas (area division) with respect to a main scan direction (rotational axis direction of the photosensitive drum) and a sub-scan direction (process direction) and then measures the pixel number every area. Then, the pixel number measuring means 104 calculates the average print ratio every area. In order to obtain a better toner amount detection accuracy by detecting the toner content in further detail, the range of each area with respect to the sub-scan direction may preferable be set at a length on the image corresponding to one-full circumference of the supplying roller 3. In this embodiment, such setting was made. Further, also with respect to the main scan direction, by measuring the pixel number after dividing the image area into the plurality of areas, even the case where there is a localization of the print area of the image to be formed with respect to the main scan direction is addressed, so that the toner content can be detected in further detail and thus the better toner amount detection accuracy can be obtained.

The pixel number measuring means 104 of the control circuit portion 101 individually measures, as shown in FIG. 11, the pixel number for each of the divided areas in ranges from An1 to Anj with respect to the sub-scan direction and in ranges from A0*n* to Ain with respect to the main scan direction. Then, the pixel number measuring means 104 calculates an average print ratio (P01 to Pij) in each area.

Incidentally, the average print ratio (P01 to Pij) can be calculated from a proportion of an integrated value of density information at each pixel in an associated area to an integrated value (total), taken as 100%, of the density information at each pixel in each area in the case where the image segments at all of the pixels in each area are the solid image. The image density information and the toner amount per unit area are associated with each other in advance and therefore the integrated value of the density information at each pixel in each area corresponds to a toner consumption (amount) in the associated area.

Next, the computing means 105 of the control circuit portion 101 performs the following computation on the basis of a calculation result of the average print ratio in each area. That is, for each page, the following computation is performed every range divided with respect to the main scan direction and then the toner contents (W0*j* to Wij) immediately after the end of the image formation every area divided with respect to the sub-scan direction are successively calculated individually every range divided with respect to the main scan direction.

$$W0j = W0(j-1)\times(1+K0j\times 10-3)$$

$$W1j = W0(j-1)\times(1+K1j\times 10-3)$$

$$W2j = W0(j-1)\times(1+K2j\times 10-3)$$

$$\vdots$$

$$Wij = Wi(j-1)\times(1+Kij\times 10-3)$$

In the above, a coefficient Kij is a fluctuation (increase and decrease) coefficient determined depending on a toner content Wi(j−1) immediately after image formation in area Ai(j−1) and an average print ratio Pij in area Aij, and can be associated in advance as shown in Table 3.

TABLE 3

| | Toner content in supplying roller Wi (j − 1) (%) | | | |
|---|---|---|---|---|
| Pij (%) | 100 ≥ Wi (j − 1) ≥ 95 | 95 > Wi (j − 1) ≥ 90 | 90 > Wi (j − 1) ≥ 80 | 80 > Wi (j − 1) ≥ 0 |
| 100 > Pi ≥ 95 | −1.0 | −0.5 | 0 | 0 |
| 95 > Pij ≥ 90 | −0.5 | −0.2 | 0 | 0 |
| 90 > Pij ≥ 50 | −0.2 | 0 | 0 | 0.2 |
| 50 > Pij | 0 | 0 | 0.2 | 0.4 |

Specifically, the relationship shown in Table 3 is based on experimental data obtained by checking the increase and decrease of the toner content depending on the print ratio of the image to be formed. That is, similarly as in Embodiment 1, for example, as shown in (c) of FIG. 8, by obtaining the change of the toner content per (one) rotation of the supplying roller 3 in the case where the so-called image with the print ratio of 100% ("100%" in the figure), the relationship as shown in Table 3 can be set in advance. In this case, it is assumed that the state of the amount of the toner contained in the supplying roller 3 immediately before the image forming operation is kept in the equilibrium state. That is, it is assumed that each of toner contents W01 to Wi0 is 100%. The computing means 105 successively calculates the final toner content Wij for each range divided for each page in the job by using the information on the relationship as shown in Table 3, thus finally obtaining the toner content Wij for each range divided with respect to the main scan direction at the time of the end of the job.

Next, the control circuit portion 101 selects the range, in which the toner content is lowest, from the ranges of the toner contents (W0*j* to Wij) which are calculated by the computing means 105 and are divided with respect to the main scan direction immediately after the image formation. Then, the control circuit portion 101 defines a minimum (MIN(W0*j*: Wij)) of the toner contents in the range as Wm. That is, the control circuit portion 101 controls the toner supplying operation, performed from after the image formation until the toner amount detecting operation is started, depending on a computation result of the toner content Wm at a position where the toner content in the supplying roller 3 with respect to the main scan direction is most exhausted at the time immediately after the image formation.

Specifically, in the control circuit portion 101, similarly as in Embodiment 1, the table as shown in Table 2 is set in advance. As described above, in this embodiment, the toner content Wm in Table 2 corresponds to the minimum (MIN (W0*j*:Wij)) of the toner contents. The control circuit portion 101 obtains, by using the information on the relationship as shown in Table 2, the rotation number of the supplying roller 3 during the toner supplying operation corresponding to the toner content Wm in the range in which the toner content in the supplying roller 3 with respect to the main scan direction is lowest.

FIG. 12 shows a flow of a series of operations of the image forming apparatus 100 including the image forming operation, the toner supplying operation and the toner amount detecting operation in this embodiment.

When the image forming apparatus 100 is in a print standby state, a print signal is inputted from the external host device 200 into the control circuit portion 101 (S201). Thereafter, the control circuit portion 101 starts the image forming operation (S202). Thereafter, the pixel number measuring means 104 of the control circuit portion 101 measures, every divided area, the pixel number of the image to be formed on the basis of image data sent from the external host device 200, so that the average print ratios P01 to Pij in the respective areas is detected (S203). Then, the computing means 105 of the control circuit portion 101 calculates, on the basis of the average print ratios P01 to Pij in the respective areas calculated from the measurement result of the pixel number, the toner content W0*j* to Wij immediately after the image formation in the respective ranges divided with respect to the main scan direction (S204). When the image formation is ended (S205), the control circuit portion 101 moves the developing device 7 from the first position to the second position by the spacing means 30 (S206). Next, the control circuit portion 101 judges whether or not the minimum Wm of the toner contents W0*j* to Wij, in the respective ranges divided with respect to the main scan direction, calculated in S204 reaches that in the equilibrium state (whether or not MIN(W0*j*:Wij)<100(%)) (S207).

In S207, in either of the ranges, in the case where the amount of the toner contained in the supplying roller 3 is judged as being in the equilibrium state (MIN(W0*j*:Wij)=100(%)), the control circuit portion 101 stops the developing roller 2 and the supplying roller 3 (S209). Then, the control circuit portion 110 executes the toner amount detecting operation (S210). On the other hand, in S207, the amount of the toner contained in the supplying roller 3 is judged as being in the exhaust state (MIN(W0*j*:Wij)<100(%)), the control circuit portion 101 executes the toner supplying operation (S208). That is, the control circuit portion 101 sets the minimum (MIN(W0*j*:Wij)) of the toner content calculated in S204 at Wm and then obtains the necessary rotation number of the supplying roller 3 on the basis of the table as shown in Table 2. Then, the control circuit portion 110 rotationally drives the developing roller 2 and the supplying roller 3 on the basis of the result. Thereafter, the control circuit portion 101 stops the developing roller 2 and the supplying roller 3 (S209) and then executes the toner amount detecting operation (S210).

As described above, according to this embodiment, the computation of the toner content necessary to determine the rotation number of the supplying roller 3 in the toner supplying operation is performed in further detail. As a result, with respect to every image pattern, it becomes possible to effect the control for restoring the state of the amount of the toner contained in the supplying roller 3 to the equilibrium state in further detail. As a result, the better toner amount detection accuracy can be obtained.

Incidentally, similarly as in Embodiment 1, the rotation number of the supplying roller 3 may also be computed more specifically by using a mathematical expression in the computing means 105 and typically may be computed so that it can be substantially changed continuously.

Further, similarly as described in Embodiment 1, the rotational speed of the supplying roller 3 during the toner supplying operation may also be increased.

Further, the number of division of the image area for the page subjected to individual pixel number measurement is merely an example and does not limit the present invention. For example, the range of each area with respect to the sub-scan direction may also be a length of not less than one-full circumference of the supplying roller 3 and, e.g., one page may be divided into (two) halves. Further, with respect to one of the sub-scan direction and the main scan direction, it is also possible that the division is not made. For example in the case where the division is not made with respect to the sub-scan direction, it is possible to obtain the rotation number of the supplying roller 3 in the toner supplying operation depending on the minimum of the toner contents, successively calculated every page, immediately after the image formation in the respective ranges divided with respect to the main scan direction. Further, in the case where the division is not made with respect to the main scan direction, the toner contents immediately after the image formation are successively calculated for the respective ranges divided with respect to the sub-scan direction to finally calculate the toner content immediately after the image formation, so that it is possible to obtain the rotation number of the supplying roller 3 necessary for the toner supplying operation. In this case, the processing for obtaining the minimum of the toner contents in this embodiment can be omitted. That is, the information on the amount of the developer used for the formed image may be consisting of information on the developer amount in each of the areas of the formed image with respect to a direction corresponding to at least one of the rotational axis direction of the developer supplying member 3 and a direction perpendicular to the rotational axis direction.

Embodiment 3

Next, another embodiment of the present invention will be described. A basic constitution and operation of an image forming apparatus in this embodiment are the same as those in Embodiment 1. Therefore, elements (means) identical or corresponding to those in Embodiment 1 are represented by the same reference numerals or symbols and will be omitted from detailed description.

In this embodiment, during the toner supplying operation, a predetermined DC voltage of the opposite polarity to the charge polarity of the toner is applied to the supplying roller 3 from the supply voltage output portion 80*b* of the supplying member power source E4, so that the developing roller 2 and the supplying roller 3 are rotated.

Specifically, after the end of the image formation, the developing device 7 is moved from the first position to the second portion and thereafter in the case where the amount of the toner contained in the supplying roller 3 is detected as being temporarily exhausted, the following operation is performed. That is, the rotational drive of the developing roller 2 and the supplying roller 3 is effected while applying 0 V from the developing power source E2 to the developing roller 2 and applying +500 V from the supply voltage output portion 80*b* of the supplying member power source E4 (the supplying device as the supplying means) to the supplying roller 3. As a result, the toner supplying operation into the supplying roller 3 is executed.

Thus, during the toner supplying operation, by applying the DC voltage of the opposite polarity to the toner charge polarity, the supplying roller 3 is rotated while causing the electrostatic attraction force to act on the toner T. That is, in this embodiment, the supplying means applies the DC voltage of the opposite polarity to the normal charge polarity of the developer to the developer supplying member 3 when the developer is supplied into the developer supplying member 3 in a period from after the image formation until the detection by the developer amount detecting means 107 is executed. As a result, it is possible to reduce the rotation number of the supplying roller 3 in the toner supplying operation necessary until the amount of the toner contained in the supplying roller 3 reaches that in the equilibrium state.

Incidentally, in this embodiment, methods of the pixel number measurement and the print ratio calculation by the pixel number measuring means 104 and a computation method of the toner content immediately after the end of the job by the computing means 105 are similar to those in Embodiment 1 or 2. Further, the flow of the series of image forming operations is also similar to that in Embodiment 1 or 2. However, in this embodiment, the rotation number of the supplying roller 3 corresponding to the same toner content can be set so as to be smaller than that in Embodiment 1 or 2.

Further, also in this embodiment, similarly as described in Embodiment 1, the combination of the control of the rotation number with the method in which the rotational speed of the supplying roller 3 during the toner supplying operation is effective in that the toner T can be more efficiently supplyed into the supplying roller 3.

Further, the DC voltage potential of the opposite polarity to the toner charge polarity applied to the supplying roller 3 during the toner supplying operation may also be changed depending on an operational environment (temperature and/or humidity) in which the image forming apparatus 100 is placed.

Other Embodiments

In the above, the present invention is described based on the specific embodiments but is not limited to the above-described embodiments.

For example, in the above-described embodiments, the image forming apparatus employs the contact developing system but the present invention is not limited to the contact developing system. For example, the present invention is effective also in an image forming apparatus using a non-magnetic jumping developing system or the like in which the supplying roller is used.

Further, in the above-described embodiments, the image forming is described as the image forming apparatus for a single color but the present invention is not limited thereto. For example, the present invention is effective also in an image forming apparatus capable of obtaining a full-color member by arranging a plurality of process cartridges similar to the process cartridge in the above-described embodiments.

Further, in the above-described embodiments, the image forming apparatus is described as that employing the process cartridge type but the present invention is not limited thereto. For example in the present invention, the developing device is singly formed in the cartridge so as to be detachably mountable to the main assembly of the image forming apparatus but the present invention is also effective in a constitution in which the developing device itself is fixed to the main assembly of the image forming apparatus so as to permit the replenishing of the developer.

Further, in the above-described embodiments, the toner supplying operation is performed at the second position where the developing roller of the developing device and the photosensitive drum are spaced but as desired may also be performed at the first portion where the developing roller and the photosensitive drum contact each other. In this case, there is a need to perform the toner supplying operation with timing other than during the image formation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 004403/2011 filed Jan. 12, 2011, which is hereby incorporated by reference.

What is claimed is:

1. An image forming apparatus comprising:

an image bearing member for bearing an electrostatic latent image;

a developing container for containing a developer;

a developer carrying member, including a first electrode member, for carrying the developer contained in said developing container to develop the electrostatic latent image;

a developer supplying member, including a second electrode member and a foam layer provided around the second electrode member, for supplying the developer contained in said developing container to said developer carrying member by rotation in contact with said developer carrying member;

a supplying device for performing a supplying operation for supplying the developer to said foam layer on the basis of a toner content in said developer supplying member, with the toner content obtained by using a print ratio of an image to be formed; and a detecting device for detecting an amount of the developer contained in said developing container by detecting electrostatic capacity between the first electrode member and the second electrode member after the supplying operation by said supplying device, wherein the supplying operation is performed if the toner content is less than a predetermined content, and wherein when the toner content is a present toner content, the present toner content is obtained by a previous toner content and a present print ratio.

2. An image forming apparatus according to claim 1, wherein said supplying device rotates, as the supplying operation, said developer supplying member by a rotation number on the basis of the print ratio.

3. An image forming apparatus according to claim 2, wherein said supplying device applies, to the second electrode member, a DC voltage of an opposite polarity to a normal charge polarity of the developer during the supplying operation.

4. An image forming apparatus according to claim 1, wherein the print ratio is measured in areas in which the image to be formed is divided with respect to a direction corresponding to at least one of a rotational axis direction of said developer supplying member and a direction perpendicular to the rotational axis direction, and wherein said supplying device rotates, as the supplying operation, said developer supplying member by a rotation number on the basis of the print ratio in the area selected from the divided areas.

5. A developing apparatus comprising:

a developing container for containing a developer;

a developer carrying member, including a first electrode member, for carrying the developer contained in said developing container to develop an electrostatic latent image; and a developer supplying member, including a second electrode member and a foam layer provided around the second electrode member, for supplying the developer contained in said developing container to said developer carrying member by rotation in contact with said developer carrying member, wherein a supplying operation is performed to supply the developer to said foam layer on the basis of a toner content in said developer supplying member which is obtained by using a print ratio of the image to be formed, wherein a detecting operation is performed to detect an amount of the developer contained in said developing container by detecting electrostatic capacity between the first electrode member and the second electrode member after the supplying operation, wherein the supplying operation is performed if the toner content is less than a predetermined content, and wherein when the toner content is a present toner content, the present toner content is obtained by a previous toner content and a present print ratio.

6. An image forming apparatus according to claim 1, wherein the supplying operation is not performed if the toner content is not less than a predetermined content.

* * * * *